US005691496A

United States Patent [19]

Suzuki et al.

[11] Patent Number: 5,691,496

[45] Date of Patent: Nov. 25, 1997

[54] MUSICAL TONE CONTROL APPARATUS FOR FILTER PROCESSING A MUSICAL TONE WAVEFORM ONLY IN A TRANSIENT BAND BETWEEN A PASS-BAND AND A STOP-BAND

[75] Inventors: Takashi Suzuki; Seiji Okamoto, both of Hamamatsu; Katsushi Ishii, Iwata; Yutaka Washiyama, Hamamatsu, all of Japan

[73] Assignee: Kawai Musical Inst. Mfg. Co., Ltd., Shizuoka-ken, Japan

[21] Appl. No.: 600,000

[22] Filed: Feb. 14, 1996

[30] Foreign Application Priority Data

| | | | |
|---|---|---|---|
| Feb. 14, 1995 | [JP] | Japan | 7-025058 |
| Feb. 14, 1995 | [JP] | Japan | 7-025059 |
| Feb. 14, 1995 | [JP] | Japan | 7-025060 |

[51] Int. Cl.[6] ..... G10H 1/12; G10H 5/00

[52] U.S. Cl. ..... 84/661; 84/659

[58] Field of Search ..... 84/622, 659, 661–663

[56] References Cited

U.S. PATENT DOCUMENTS

| | | | |
|---|---|---|---|
| 4,111,090 | 9/1978 | Deutsch . | |
| 4,114,496 | 9/1978 | Deutsch . | |
| 4,131,361 | 12/1978 | Morokuma et al. . | |
| 4,813,328 | 3/1989 | Takauji | 84/661 X |
| 5,117,725 | 6/1992 | Takauji et al. . | |
| 5,245,126 | 9/1993 | Saito et al. . | |
| 5,252,773 | 10/1993 | Kozuki et al. | 84/661 X |
| 5,270,954 | 12/1993 | Sakata . | |
| 5,428,183 | 6/1995 | Matsuda et al. | 84/661 X |
| 5,504,270 | 4/1996 | Sethares | 84/645 |

FOREIGN PATENT DOCUMENTS

| | | |
|---|---|---|
| 51-8924 | 1/1976 | Japan . |
| 63-98699 | 4/1988 | Japan . |
| 3-177898 | 8/1991 | Japan . |
| 3-204696 | 9/1991 | Japan . |

*Primary Examiner*—Jonathan Wysocki
*Assistant Examiner*—Jeffrey W. Donels

[57] ABSTRACT

Only in a transient band of a filter, substantially all frequency bands of the musical tone waveform are subjected to filter processing. Due to this, the drawback that the amount of change of the frequency characteristic of the musical tone gradually changes as a whole from a fundamental wave toward a harmonics and only one part of the frequency characteristic of the musical tone changes is eliminated.

Also, the density of frequency components of the frequency band of the musical tone waveform does not change, the related frequency band is shifted in frequency, subjected to filter processing, and further shifted to a frequency in accordance with the musical tone pitch. Due to this, a specific range of the filter characteristic is selected, and the musical tone is subjected to the filter control only within this range. Then, after the filter processing, the musical tone is shifted in frequency in accordance with the musical tone pitch, and therefore the musical tone is subjected to the filter processing irrespective of the musical tone pitch.

Further, the density of the frequency components of the frequency band of the musical tone waveform does not change and the related frequency band is shifted in frequency. Due to this, a harmonics ratio of the frequency components of the frequency band changes, a timbre (musical tone quality) finely changes, and a control on the musical tone which has not conventionally existed is achieved.

Also, gains of boundary portions of frequency bands of a plurality of partial musical tone waveforms subjected to the filter processing are matched. Due to this, the gains of the boundary portions of the frequency bands of the partial musical tone waveforms are matched, and a well balanced synthesized musical tone is output.

42 Claims, 19 Drawing Sheets

FREQ. CHARACTERISTIC OF BAND CONTROL FILTER A06

FREQ. CHARACTERISTIC OF FRM. CONTROL FILTER A20

FIG. 10

A90

SHIFT FILTER TABLE

| | ※1 → | | | | |
|---|---|---|---|---|---|
| ※2 ↓ | SCj (t)<br>FSj (t)<br>fs1(Ts1)<br>ENV. SPEED<br>A1, A2, A3, ···<br>GFj (t)<br>FREQ. MODULATION INFO.<br>⋮ | SCj (t)<br>FSj (t)<br>fs1(Ts1)<br>ENV. SPEED<br>A1, A2, A3, ···<br>GFj (t)<br>FREQ. MODULATION INFO.<br>⋮ | SCj (t)<br>FSj (t)<br>fs1(Ts1)<br>ENV. SPEED<br>A1, A2, A3, ···<br>GFj (t)<br>FREQ. MODULATION INFO.<br>⋮ | ·····<br>·····<br>·····<br>

MUSICAL TONE CONTROL APPARATUS FOR FILTER PROCESSING A MUSICAL TONE WAVEFORM ONLY IN A TRANSIENT BAND BETWEEN A PASS-BAND AND A STOP-BAND

BACKGROUND OF THE INVENTION

1. Field of the Invention

The present invention relates in one of its aspects to a musical tone control apparatus, particularly to an improvement of filter control of a musical tone, to a frequency shift of a musical tone, and to filter control, relates in another aspect to matching the gain by the filter control of a plurality of partial musical tone waveforms to be combined (synthesized), and relates in still another aspect to a frequency shift of a musical tone. Also, the present invention relates to a method of storing a musical tone waveform and a method of playing back a musical tone waveform, more particularly relates to a method of storage and a method of reproduction (playback) of a musical tone waveform using a frequency shift of a musical tone.

2. Description of the Related Art

In the past, in the field of the filter control of a musical tone, use has been made of a pass band and a stop band of the characteristic of the filter. The cut-off frequency between the pass band and the stop band was adjusted to an upper limit or a lower limit of the frequency region desired to be cut. Due to this, only the frequency components more than the cut-off frequency among all frequency components of the musical tone have been cut or only the frequency components less than the cut-off frequency have been cut. As a result, some harmonic components of the musical tone were cut, or conversely some subharmonic components were cut, and the timbre of the musical tone changed.

Also, in the past, the frequency band of the musical tone to be subjected to the filter control largely changed according to the pitch of the musical tone. For example, the fundamental frequency of a musical tone with a musical tone name A4 is 440 Hz, and the fundamental frequency of the musical tone with a musical tone name A5 higher than this by 1 octave is 880 Hz. Accordingly, if the pitch of the musical tone to be subjected to the filter control changes, the characteristic of the cut-off-frequency of the filter etc. changes in accordance with this.

Further, in the past, in the field of control of a musical tone, the frequency band of the musical tone waveform was not subjected to shift control in terms of the frequency. However, if the frequency band of the musical tone waveform is shifted in terms of the frequency, as shown in FIG. 12(2) and FIG. 12(4), a musical tone having a different timbre (musical tone quality) is realized.

Also, in the past, where the musical tone waveform stored in a musical tone waveform memory is read out, if the speed of reading is changed in accordance with the musical tone pitch, the density of the frequency components of the frequency band of the musical tone waveform to be read out changes. For example, when the musical tone pitch doubles and the speed of reading of the musical tone waveform doubles, the width of the formant of the musical tone waveform to be read out is expanded double and the density of the frequency components of the formant becomes halved.

Further, in the past, in the field of storage of a musical tone waveform, the musical tone waveform which is generated is sampled at every cycle in accordance with a sampling signal, a sampling point of this is subjected to A-D (analog to digital) conversion, and the digital point data are stored in the musical tone waveform memory in that order. Also, in the field of reproduction (playback) of a musical tone waveform, the sampled musical tone waveforms stored in this musical tone waveform memory are read out in order at a speed in accordance with the musical tone pitch.

SUMMARY OF THE INVENTION

Due to the filter control as mentioned above, only one part of the frequency characteristic of the musical tone changed and there is no overall change in terms of the frequency. A first object of the present invention is realization of filter control which is completely different from filter control by the pass band and the stop band of a filter. In the present invention, almost all frequency bands of the musical tone waveform are subjected to filter processing only in a transient band between the pass band and the stop band of the filter. Also, in the present invention, the density of the frequency components of the frequency band of the musical tone waveform does not change, the related frequency band is shifted in terms of the frequency, subjected to the filter processing, and further shifted to the frequency in accordance with the musical tone pitch.

Due to this, in the transient band of the filter, the attenuation characteristic gradually changes, and therefore the amount of change of the frequency characteristic of the musical tone to be subjected to the filter control gradually changes as a whole from the fundamental wave toward harmonics or from the harmonics toward the fundamental wave. For this reason, it is not only one part of the frequency characteristic of the musical tone that changes, the musical tone changes as a whole in terms of the frequency, and thus control of the musical tone which has not conventionally been possible is realized.

Also, due to this, a specific range of characteristic of the filter is selected, the filter control is carried out only in this range, and the filter characteristic is stably realized. Further, after the filter processing, the frequency is shifted in accordance with the musical tone pitch and therefore the filter processing is carried out irrespective of the musical tone pitch. Note that, it is also possible that the characteristic of the filter be changed.

Also, if the musical tone pitch of the musical tone to be subjected to the filter control as mentioned above changes, the characteristic of the cut-off frequency etc. of the filter changes. A second object of the present invention is to enable the filter control to be carried out irrespective of the musical tone pitch and thereby realize a stable filter characteristic. Further, if the change in accordance with the musical tone pitch is realized without a change of density of the frequency components of the frequency band of the musical tone waveform, the timbre (musical tone quality) can finely change in accordance with the musical tone pitch. A third object of the present invention is to realize control of the musical tone by a frequency shift, which has not been possible in the past. A fourth object of the present invention is to realize a method of storage of a musical tone waveform and a method of reproduction (playback) of a musical tone waveform with which the width of the formant does not change even if the musical tone pitch changes as mentioned above.

For this reason, in the present invention, the density of the frequency components of the frequency band of the musical tone waveform does not change, and the related frequency band is shifted in terms of the frequency. Also, in the present invention, the density of the frequency components of the frequency band of the musical tone waveform does not change, the related frequency band is shifted in terms of the frequency, and at least one formant is selected and extracted from among a plurality of formants of the same format generated by this shift by the filter processing and stored. Further, in the present invention, the density of the frequency components of the frequency band of the musical tone waveform which is stored does not change, the related frequency band is shifted in terms of the frequency and then the musical tone waveform is output.

Due to this, the density of the frequency components of the frequency band of the musical tone waveform does not change, the related frequency band is shifted in terms of frequency, the harmonics ratio of the frequency components of the frequency band changes, the timbre (musical tone quality) finely changes, and control of the musical tone, which has not been possible in the past, is carried out. Also, since the density of the frequency components of the frequency band of the musical tone waveform does not change and the related musical tone waveform is shifted in frequency for storage and reproduction (playback), the width of the formant of the related musical tone waveform is always made constant irrespective of the musical tone pitch. Further, in the frequency shift, if the frequency of the musical tone waveform is made low, the storage sampling frequency of the musical tone waveform may be kept low and the musical tone waveform to be stored may be stored after being subjected to data compression.

Also, in the filter control mentioned above, where the musical tone to be subjected to the filter control is a plurality of partial musical tone waveforms having different frequency bands, these partial musical tone waveforms are synthesized, and one musical tone is output, unless some countermeasure is taken, the gains of the partial musical tone waveforms will not coincide and a musical tone different from the musical tone to be realized will be generated. A fifth object of the present invention is to enable the generation of a well-matched synthesized musical tone in the case where a plurality of partial musical tone waveforms having different frequency bands are subjected to filter control, synthesized and output.

For this reason, in the present invention, the gains of the boundary portions (units) of the frequency bands of the filtered plurality of partial musical tone waveforms are matched so that the gain of the frequency band of a certain partial musical tone waveform will substantially coincides with the gain of the frequency band of another partial musical tone waveform. Due to this, the gains of the frequency band boundaries of the partial musical tone waveforms will be matched and a well balanced synthesized musical tone will be output.

BRIEF DESCRIPTION OF THE DRAWINGS

FIG. 10 is a view showing a shift filter table A90;

FRM.: FORMANT, CKT.: CIRCUIT, GEN.: GENERATION, PAR.: PARAMETER, FREQ.: FREQUENCY, INFO.: INFORMATION, ENV.: ENVELOPE, INTPO.: INTERPOLATION.

DESCRIPTION OF THE PREFERRED EMBODIMENTS

Summary of the Embodiment

Figure 2:
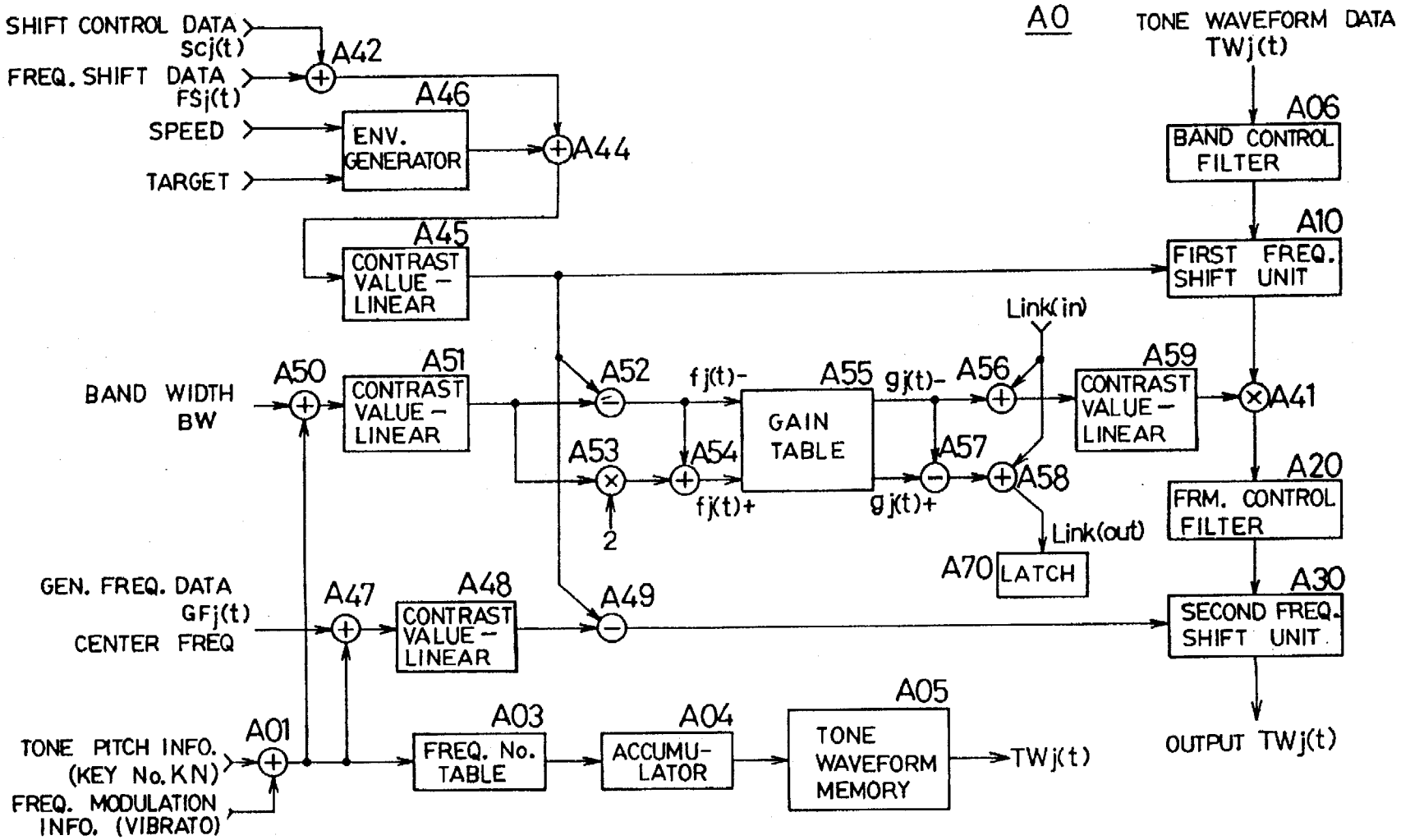
FIG. 2 is a circuit diagram showing a shift filter unit A0
Figure 8:
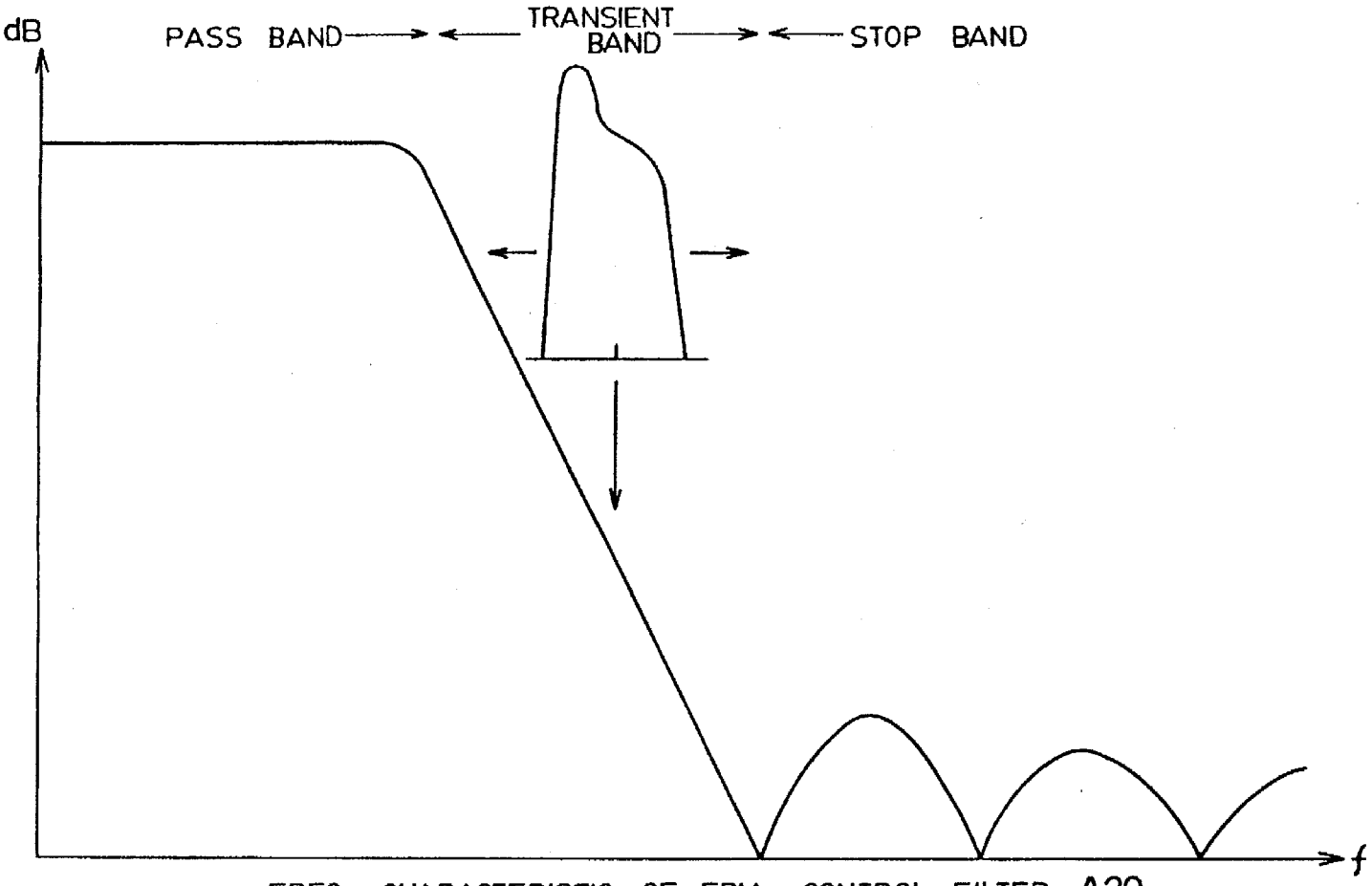
FIG. 8 is a view showing the frequency characteristic of the formant control filter A20.
Figure 9:
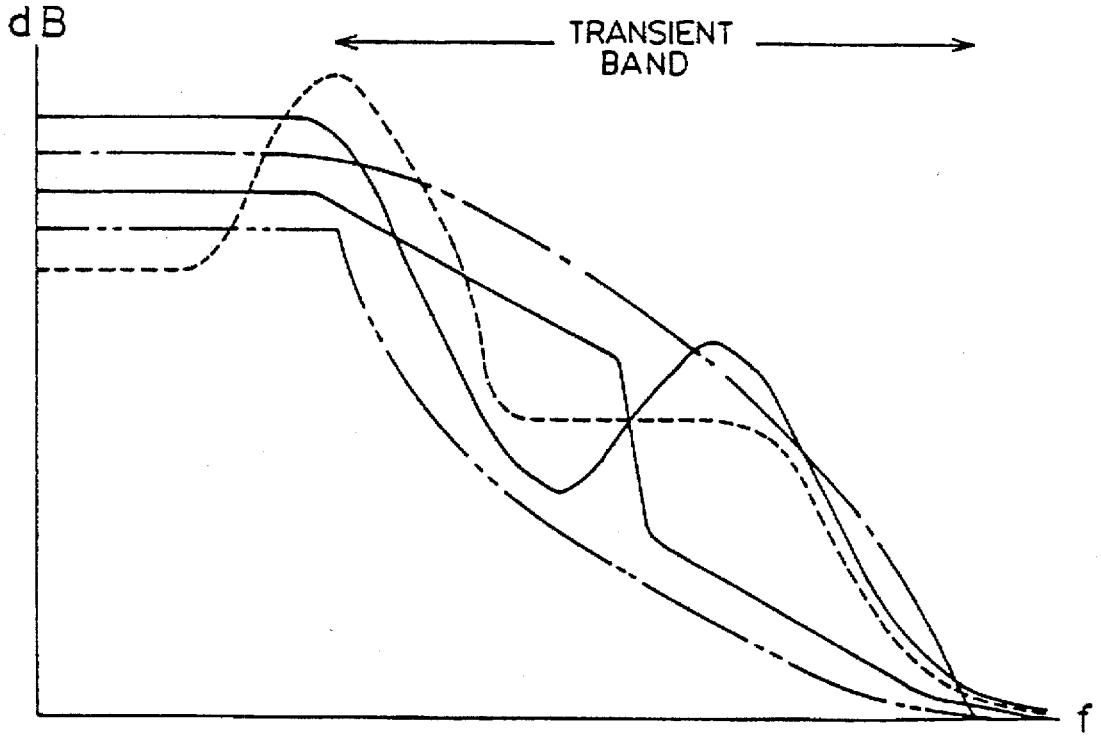
FIG. 9 is a view showing the frequency characteristic of another example of the formant control filter A20.

As shown in FIG. 2, the musical tone waveform data TWj(t) is restricted in band by the band control filter A06 and frequency-shifted up to the transient band of the formant control filter A20 by the first frequency shift unit A10. The same data TWj(t) is subjected to filter processing so that the amount of change of the frequency characteristic gradually changes as a whole from the fundamental wave toward the harmonics or from the harmonics toward the fundamental wave in the transient band of the formant control filter A20. This filter characteristic is shown in FIG. 8 or FIG. 9. Then, the same data TWj(t) is shifted up to the frequency in accordance with the musical tone pitch by the second frequency shift unit A30. These frequency shifts are carried out, as shown in FIG. 11, by multiplication of a $\cos\omega\ sj(t)$, $\sin\omega\ sj(t)$, so that the frequency band of the musical tone waveform data $TWj(t)=\Sigma\ An\times\cos\omega\ n(t)+\Sigma\ Bn\times\sin\omega\ n(t)$ is shifted intact exactly by $-\omega\ sj$ (low pass) or $\omega\ sj$ (high pass).

Figure 11:
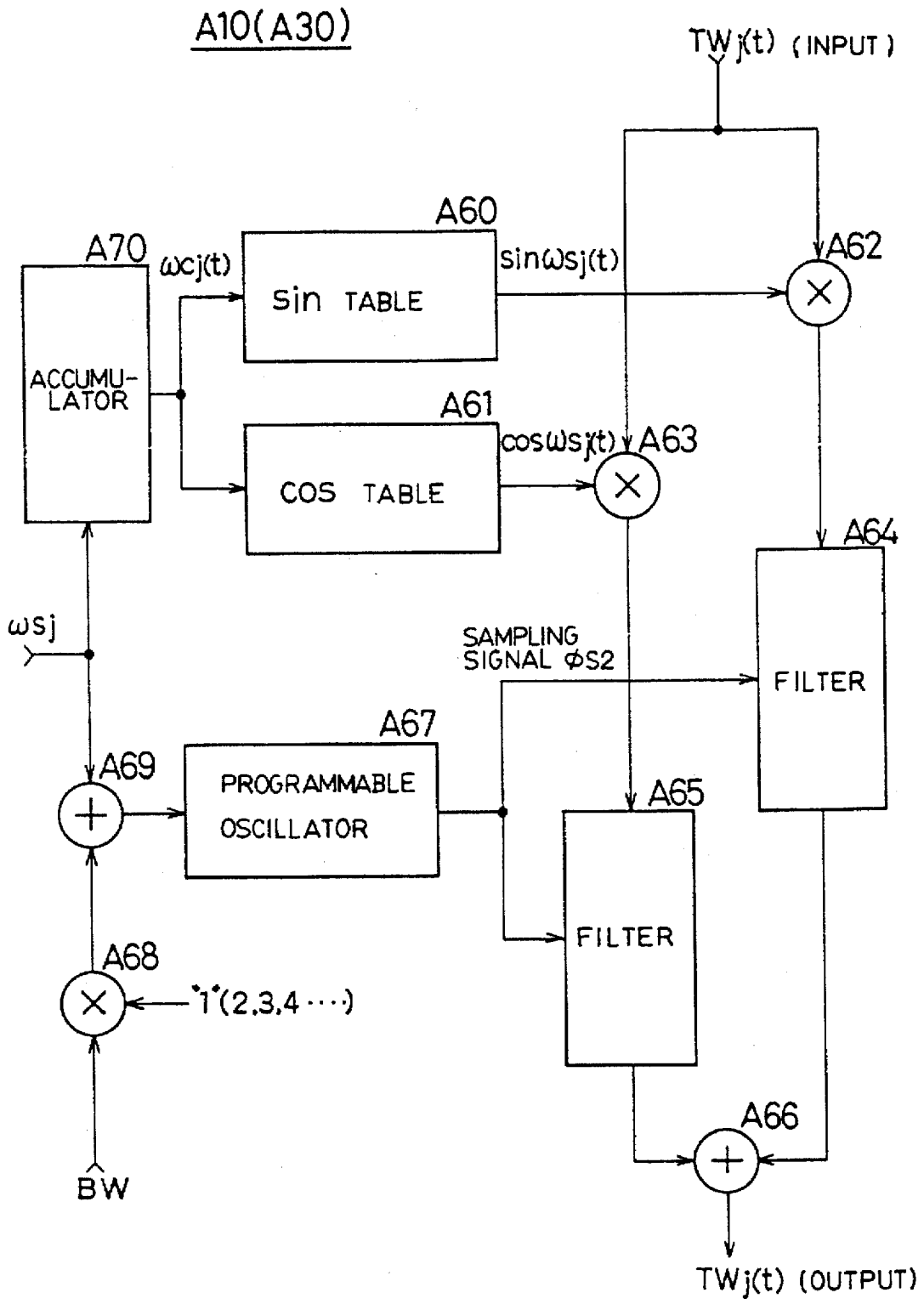
FIG. 11 is a circuit diagram showing the first frequency shift unit A10 Or the second frequency shift unit A30.

Also, as shown in FIG. 11, the musical tone waveform data TWj(t) is multiplied by $\cos\omega\ sj(t)$ and $\sin\omega\ sj(t)$ at the multipliers A62 and A63, pass through the filters A64 and A65, and are added and synthesized at an adder A66. Due to this multiplication, the frequency band of the musical tone waveform data $TWj(t)=\Sigma\ An\times\cos\omega\ n.\ (t)+\Sigma\ Bn\times\sin\omega\ n(t)$ is shifted intact exactly by $-\omega$ sj(low pass) or $\omega$ sj(high pass). The stored waveform data Icj(t) and Isj(t) are multiplied by $\cos\omega$ rj(t) and $\sin\omega$ rj(t) at the multipliers A97 and A96 of FIG. 15, shifted in frequency, added and synthesized at an adder A92, and reproduced for output.

Figure 5:
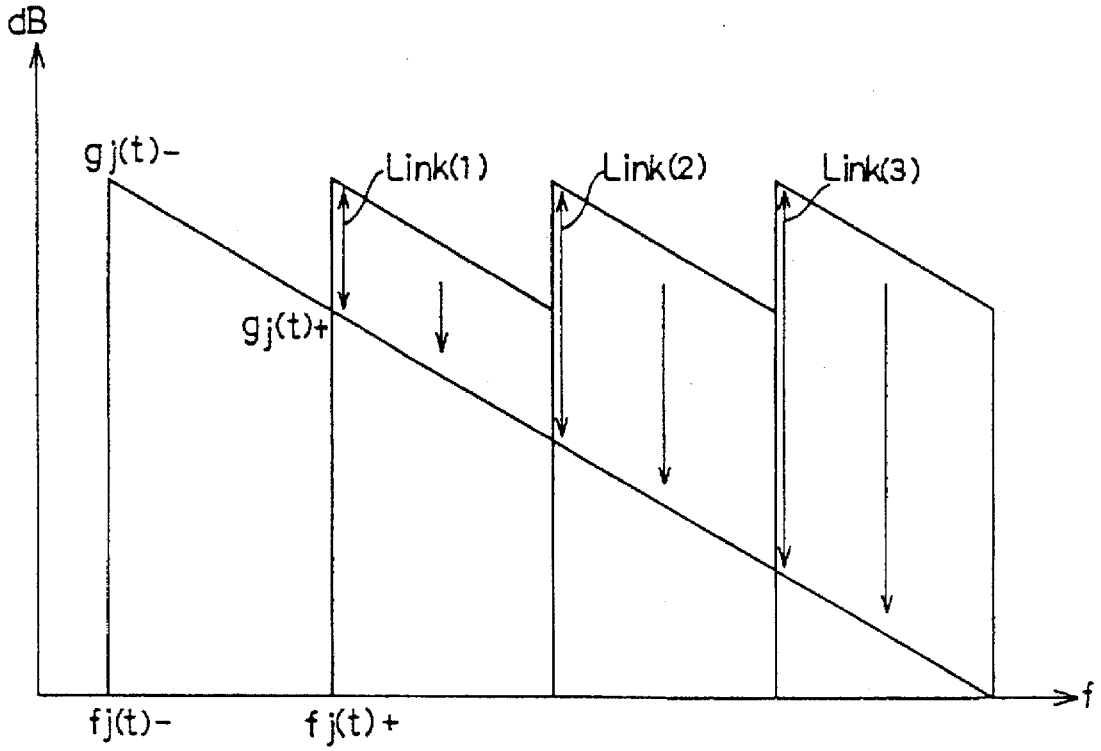
FIG. 5 is a view showing a state of matching of gains for the boundary of frequency bands of partial sounds of a musical tone waveform data TWj(t) in the transient band of the formant control filter A20

Further, as shown in FIG. 2, an upper end frequency value fj(t)+ and a lower end frequency value fj(t)− of the frequency bands of the partial musical tone waveforms are supplied to a filter gain table A55 as a reading address data, and gain data gj(t)+ and gj(t)− of the formant control filter A20 are read out. As shown in FIG. 5, the lower end gain data gj(t)− is added with link data Linkj(t) at an adder A56, the gains of the partial musical tone waveform are modified by the multiplier A41, and the gains of the boundary portions (units) are matched. The lower end gain data gj(t)− is Subtracted from the upper end gain data gj(t)+, the link data Linkj(t) is added to this, and the resultant value is output as the next link data Linkj(t).

1. Overall Circuit

Figure 1:
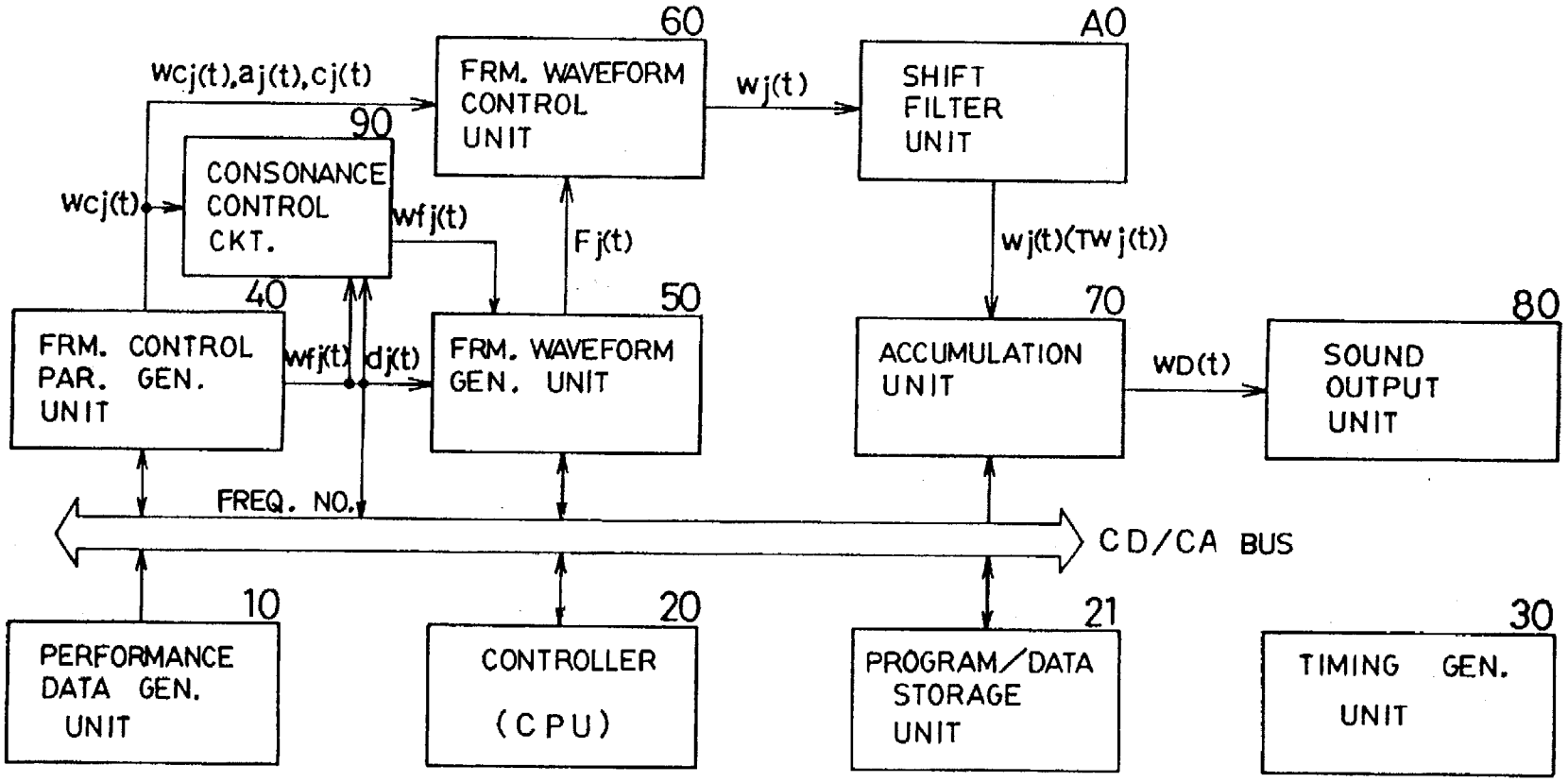
FIG. 1 is an overall circuit diagram of a musical tone waveform generation apparatus and a musical tone control apparatus

FIG. 1 shows the overall circuit of a musical tone generation apparatus. Musical tone pitch information and other performance information are generated from a performance information generation unit 10. This performance information generation unit 10 is a sounding start instruction device for manual performance, an automatic performance device, or an interface. The performance information, that is, musical factor information such as musical tone pitch information (musical tone pitch range information (including the higher keys, lower keys, and foot keys)), elapsed time information from the start of sound, performance part information, musical tone part information, musical instrument part information, etc. are generated from this performance information generation unit 10. The sounding start instruction device is a keyboard instrument,string instrument, wind instrument, percussion instrument, keyboard of a computer, etc. The auto playing apparatus automatically plays the stored performance information. The interface is a MIDI (musical instrument digital interface) etc. and receives and sends the performance information from the device to which it is connected.

Various types of switches are provided in this performance information generation unit 10. These various types of switches are a timbre tablet, effect switch, rhythm switch, pedal, wheel, lever, dial, handle, touch switch, etc. for musical instruments. From these various types of switches, the musical factor information is input. This musical factor information includes timbre information, touch information (speed/intensity of sounding start instruction operation), effect information, rhythm information, sound image (stereo) information, quantize information, modulation information, tempo information, volume information, formant characteristic information, envelope information, elapsed time from the start of sound, etc.

Also these musical factor information are included in the performance information, input from the various types of switches, included in the auto-performance information, and included in the performance information transmitted or received at the interface. Note that, the touch switches are provided corresponding to the sounding start instruction devices one by one, and initial touch data and after touch data indicating the speed and intensity of the touch are generated. The timbre information correspond to the instrumental sounds of a keyboard instrument (piano etc.), wind instrument (flute etc.) string instrument; (violin etc.), percussion instrument (drum etc.), and so on. The envelope information includes the envelope level, envelope phase, etc. The performance part information, musical tone part information, and musical instrument part information correspond to for example a melody, accompaniment, chord, base, etc., or the higher keys, lower keys, foot keys, etc. This musical factor information is sent to a controller 20 which performs switching of various signals, data, and parameters mentioned later.

The performance information is processed at the controller 20. Various data are sent to a formant control parameter generation unit 40, a formant form waveform generation unit 50, and an accumulation unit 70, and a formant synthesized signal Wj(t) is generated. The controller 20 comprises a CPU etc. A program/data storage unit 21 comprises a storage device such as a ROM, RAM, etc. in this program/data storage unit 21, a program for performing various processings by the controller 20, the above various types of data, and the other various types of data are stored. These various types of data include also data necessary for time-division processing, data for assignment to the time-divided channels, etc.

By the formant control parameter generation unit 40, the formant form waveform generation unit 50 and the formant waveform control unit 60, the formant synthesized signal Wj(t) is generated in a time sharing manner. The "j" of Wj(t) indicates the degree of division of the time-division processing or the channel number. From the formant control parameter generation unit 40, various parameters necessary for generating the formant synthesized signal Wj(t), that is, the formant control parameters $\omega$ cj(t), $\omega$ fj(t), aj(t), cj(t), dj(t), etc. are generated.

A detailed description of these parameters is given in the specifications and drawings of U.S. patent application Ser. Nos. 08/312,612, 08/394,279, and 08/493,324. In the formant formwaveform generation unit 50 and the formant waveform control unit 60, based on the input formant control parameter, the formant synthesized signal Wj(t) is read out, generated, and synthesized. This formant synthesized signal Wj(t) As subjected to various types of controls at the shift filter unit A0, accumulated and synthesized at an accumulation unit 70 for every series channel, sounded, and output as a musical tone from the sound output unit 80. This series indicates one musical tone of the formant synthesized signal Wj(t) which is a partial sound or the above musical factor.

From a timing generation unit 30, a timing control signal for establishing synchronization of all circuits of the musical tone generation apparatus is output to the circuits. The timing control signals are clock signals of respective cycles. Other than them, there are signals obtained by performing a logical AND or logical OR for these clock-signals, a signal having a cycle of the channel division time of the time-division processing, a channel number data j, etc.

The frequency number data PN (musical tone pitch information) read out from an assignment memory 213 of the program/data storage unit 21 by the controller 20 etc. in the time sharing manner or the formant density parameter $\omega$ fj(t) or the formant carrier parameter $\omega$ cj(t) from the formant control parameter generation unit 40 is sent to a consonance (consonance degree) control circuit 90.

These data FN($\omega$ fj(t), $\omega$ cj(t)) are synthesized with a formant carrier parameter $\omega$ cj(t) from the formant control parameter generation unit 40, a sampling modification data Sfj(t) from the controller 20, and the synthesized formant consonance (consonance degree) data Hj(t) at the consonance control circuit 90. The resultant signal is sent as the formant density $\omega$ fj(t) to the parameter formant form waveform generation unit 50.

Due to this synthesizing, the contrast value of the frequencies of the frequency components of the formant of the formant waveform signals Fjf(t) and Fj(t) is determined, and the degree of consonance (harmony) of the frequency components of the formant is controlled. In this case, the frequency number data FN is sent to the consonance control circuit 90 as it is or subjected to the operation (include calculation computation) processing and sent to the consonance control circuit 90. This operation (computation) involves other data and includes the various calculations (operations, computations) (1) mentioned later.

Descriptions of the concrete configurations, operations, etc. of the circuits 10, 20, 21, 30, 40, 50, 60, 70, 80, and 90 of FIG. 1 are all disclosed in the specifications and drawings of U.S. patent application Ser. Nos. 08/312,612, 08/394,279, and 08/493,324. Accordingly, a concrete explanation of these circuits will be made by referring to the specifications and drawings of U.S. patent application Ser. Nos. 08/312,612, 08/394,279, and 08/493,324, and is not made in the specification and drawings of the present application. All of the disclosed contents of specifications and drawings of U.S. patent application Ser. Nos. 08/312,612, 08/394,279, and 08/493,324 are regarded to be disclosed in the specification and drawings of the present application.

In the shift filter unit A0, shift processing of the frequency band of the input formant synthesized signal Wj(t) (musical tone waveform data TWj(t)) and filter processing are carried out and the frequency characteristic is changed and output. Note that, in another example, this shift filter unit A0 is provided between a multiplier 66 in the formant waveform control unit 60 and the formant form waveform generation unit 50 (or a multiplier 652).

2. Shift Filter Unit A0

FIG. 2 shows a shift filter unit A0. The musical tone pitch information, (key number KN) from the performance information generation unit 10 is added with a frequency modulation information at an adder A01. This frequency modulation information is based on the information such as a vibrato in the musical effect information input from the performance information generation unit 10 etc.

The musical tone pitch information etc. from the adder A01 is converted to a frequency number data FN by a frequency number table A03. This frequency number data FN is accumulated for each channel at an accumulator A04 by the time sharing manner and sent to the musical tone waveform memory A05. In the musical tone waveform memory A05, a large number of musical tone waveform data TWj(t) are stored for every musical factor such as the timbre, musical tone pitch range, touch, etc., for every elapsed time from the start of sounding, for every envelope level/phase, and every selection data of an operator in multiple levels. The data in accordance with these musical factors etc. are read out. Note that, the reading speed of this musical tone waveform data TWj(t) does not have to be in accordance with the musical tone pitch.

Part or all of the musical tone waveform data TWj(t) is a plurality of partial musical tone waveforms in which the frequency bands are substantially not overlapped or are partially overlapped in certain cases and which pass through a second frequency shift unit A30 mentioned later and then are synthesized to one musical tone at an accumulation unit 70 for output. Accordingly, these partial musical tone waveforms can be the musical tone waveforms obtained by dividing originally one musical tone waveform to a plurality of frequency bands by the filter processing. The center frequency of the frequency bands of the stored musical tone waveform data TWj(t) can be brought to an imaginary frequency "0" as will be mentioned later. The musical tone waveform memory A05 may also be detachable from the musical tone generation apparatus or be a CD-ROM/RAM, ROM/RAM card, or the like.

The musical tone waveform data TWj(t) read out from this musical tone waveform memory A05 in the time sharing manner is interpolated at the sampling points of the waveform by an interpolation circuit (not illustrated) and then sent to a band control filter A06. This interpolation circuit is the same as an interpolation circuit AB3 of FIG. 13 mentioned later. This musical tone waveform data TWj(t) may be the formant synthesized signal Wj(t) from the formant waveform control unit 60 or also may be the above formant waveform signal Ffj(t) or Fj(t) or the formant carrier signal Gfj(t) or cosω cj(t). After this, these signals will be referred to overall as the musical tone waveform data TWj(t).

Figure 3:
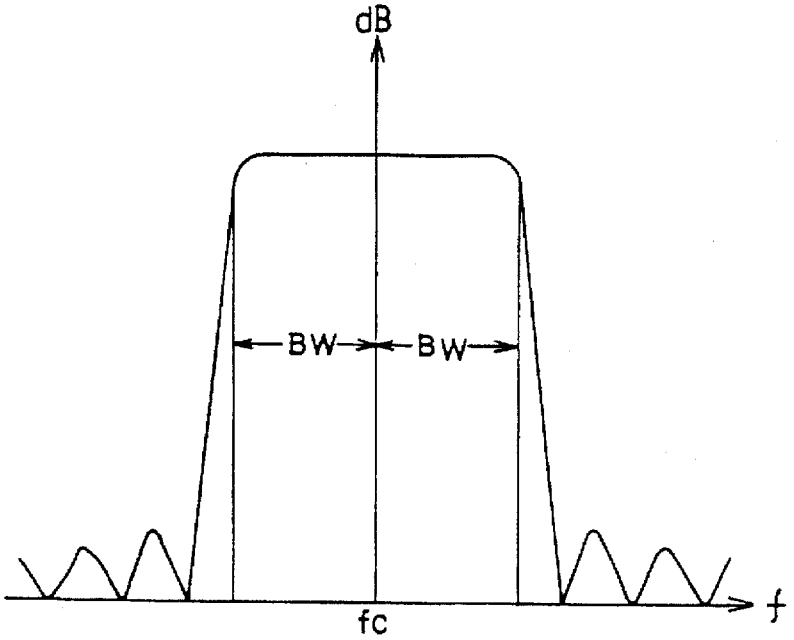
FIG. 3 is a view showing a frequency characteristic of a band control filter A06

The band control filter A06 is a digital filter. In the band control filter A06, as shown in FIG. 3 mentioned later, only the frequency bands having a band width BW above or beneath the center frequency of the musical tone waveform data TWj(t) are extracted. The other frequency bands are cut. Due to this, almost all frequency bands of this musical tone waveform data TWj(t) subjected to the filter processing at the formant control filter A20 mentioned later are restricted to the transient band of the formant control filter A20. Of course, if the transient band of the formant control filter A20 is wide, any value can be taken as the above predetermined width. Moreover, although a band-pass filter is desirable as the band control filter A06, it is also possible if a high-pass filter or low-pass filter is adopted.

Also, if the frequency band of the musical tone waveform data TWj(t) to be input is narrow or the transient band of the formant control filter A20 is wide and almost all frequency bands of the musical tone waveform data TWj(t) are within the transient band of the formant control filter A20, the-band control filter A06 can be dotted. In this case, the musical tone waveform data TWj(t) passed through the band control filter A06 can be stored in the musical tone waveform memory A05.

Also, when the musical tone waveform data TWj(t) is a partial musical tone waveform, only the narrow area of the transient band of the formant control filter A20 can be used. Then, even if the actual frequency characteristic of the foment control filter A20 is nonlinear as shown in FIG. 9, the linear frequency characteristic shown in FIG. 5 is realized.

Figure 4:
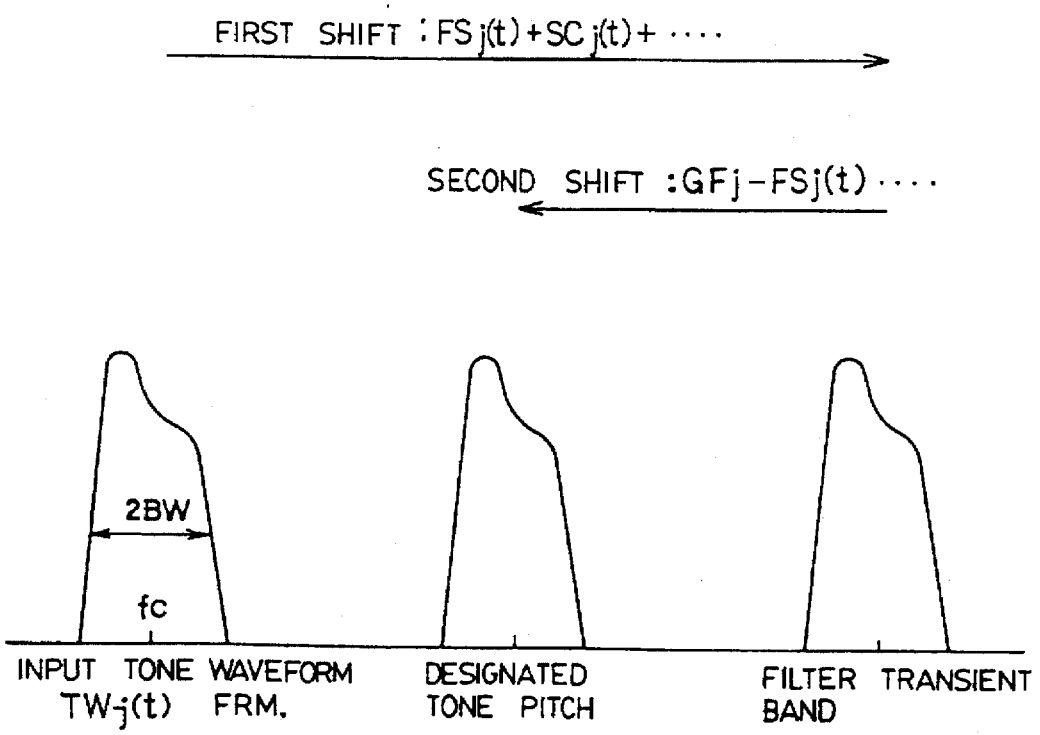
FIG. 4 is a view showing a frequency shift of a first frequency shift unit A10 and a second frequency shift unit A30

The musical tone waveform data TWj(t) from the band control filter A06 is shifted in the overall frequency band at the first frequency shift unit A10. Due to this shift, the frequency band of the musical tone waveform data TWj(t) is shifted up to the transient band of the formant control filter A20 as shown in FIG. 4. This frequency-shifted musical tone waveform data TWj(t) is subjected to filter processing so that the amount of change of the frequency characteristic gradually changes from the fundamental wave toward the harmonics or from the harmonics toward the fundamental wave at the formant control filter A20 via the multiplier A41.

This filtered musical tone waveform data TWj(t) is further subjected to the shift of the entire frequency band at the second frequency shift unit A30. Due to this shift, as shown in FIG. 4, the frequency band of the musical tone waveform data TWj(t) is shifted up to the position in accordance with the musical tone pitch. This frequency-shifted musical tone waveform data TWj(t) is output to the accumulation unit 70. In this case, it is also possible to multiply and synthesize the envelope level data (formant control parameters aj(t), ajk(t))

via the multiplier. These first shift direction and second shift direction are the same or different in accordance with the indicated musical tone pitch or the frequency position of the transient band of the formant control filter A20.

The frequency shift data FSj(t) which is generated in a time sharing manner is added with the shift control data SC at an adder A42 in a time sharing manner, and the envelope data is added to this at an adder A44. The frequency shift data FSj(t) from the adder A44 is converted to a linear value at a contrast value—linear conversion circuit A45 and sent to the first frequency shift unit A10. Due to this, the musical tone waveform data TWj(t) is shifted in frequency in accordance with the value of the frequency shift data FSj(t).

To an envelope generator A46, an envelope speed data and an envelope target data are supplied in a time sharing manner. Due to this, the envelope data is generated in the time sharing manner. It is also possible to substitute the envelope level data (formant control parameters aj(t) and ajk(t)) for this envelope data.

This frequency shift data FSj(t) is a value in accordance with the difference between the center frequency of the frequency band of the musical tone waveform data TWj(t) and the center frequency of a part to be used for the filter processing of the transient band of the formant control filter A20. The center frequency of the musical tone waveform data TWj(t) is determined in accordance with the ratios between the frequency at the time of storage of the musical tone waveform data TWj(t), a storage sampling frequency, and a read out frequency, or the same as the generation frequency of the musical tone waveform data TWj(t).

The generation frequency data GFj(t) is the data in accordance with the ratio between the frequency at the time of the storage of the musical tone waveform data TWj(t) and the storage sampling frequency. This generation frequency data GFj(t) is added with the musical tone pitch information at an adder A47 and becomes a value in accordance with an actual musical tone pitch. This generation frequency data GFj(t) represents the center frequency of the frequency bands of the musical tone waveform data TWj(t) stored in the musical tone waveform memory A05. If the center frequency of the frequency bands is the imaginary frequency "0", this generation frequency data GFj(t) also sometimes becomes 0".

This generation frequency data GFj(t)+musical tone pitch information is converted to a linear value at the contrast value—linear conversion circuit A48, the frequency shift data FSj(t)+shift control data SCj(t)+envelope data is subtracted at a subtracter A49, and the resultant value is sent to the second frequency shift unit A30. Due to this, as shown in FIG. 4, the amount of the frequency shift at the first frequency shift unit A10 is subtracted from the amount of the frequency shift of the musical tone waveform data TWj(t) to the original musical tone pitch, and the frequency shift is carried out only for the remaining amount at the second first shift unit A30.

The musical tone pitch information from the adder A01 is added with the value of the band width BW at an adder A50 and is converted to a linear value at the contrast value—linear conversion circuit A51. Due to this, an upper end frequency value fj(t)+ and a lower end frequency value fj(t)− of the musical tone waveform data TWj(t) passed through the band control filter A06 and restricted in band to the band width + BW are found. This frequency value fj(t) is subtracted from the frequency shift data FSj(t) at a subtracter A52 and doubled at a data shifter (multiplier) A53, added with the data from the subtracter A52 at an adder, and modified in accordance with the frequency shift at the first frequency shift unit A10.

This upper end frequency value fj(t)+ and the lower end frequency value fj(t)− are supplied as the reading address data to the filter gain table A55, and gain data gj(t)+ and gj(t)− in accordance with the frequency values fj(t) are read out. This type of two filter gain tables A55 are provided in parallel, but it is also possible if they are replaced by two input latches, a multiplexer, a filter gain table A55, a demultiplexer, and two output latches and time division processing is carried out. Needless to say the gain data of this filter gain table A55 indicates the frequency characteristic of the formant control filter A20 and is found from the filter operation parameter of the formant control filter A20 by computation.

As shown in FIG. 5, the lower end gain data gj(t)− is added with the link data Linkj(t) at an adder A56 and converted to a linear value at a contrast value—linear conversion circuit A59 and sent to the multiplier A41. On the other hand, the lower gain data gj(t)− is subtracted from the upper end gain data gj(t)+ at a subtracter A57, the link data Linkj(t) is added to this at an adder A58, and the resultant data is output as a new link data Linkj(t). This link data Linkj(t) is stored in a latch A70 and input to the adder A56 as the next link data Linkj+1 (t). This latch A70 is cleared by a trigger signal of a constant cycle from the timing control unit 30. The cycle of this trigger signal is equal to the division time of the amount of 4 channels if there are four partial sounds per one musical tone. Note that, it is also possible even if the multiplier A41 is provided on the output side of the formant control filter A20.

The reason why such a filter gain table A55 and multiplier A41 are provided is as follows. For each sounding start instruction or each musical tone, there are a plurality of musical tone waveform data TWj(t) as mentioned above which are partial sounds. In the shift filter unit A0 of FIG. 1, the musical tone waveform data TWj(t) comprised of these respective partial sounds is subjected to musical tone control processing such as filtering processing at an inclined transient band shown in FIG. 7.

For this reason, in the filter processing for each of the partial sounds at the formant control filter A20, as shown in FIG. 5, gain matching becomes necessary at the boundary of the frequency bands of the partial sounds. For this reason, the filter gain table A55, multiplier A41, adders A56 and A58, subtracter A57, etc. are provided. Where the musical tone waveform data TWj(t) is not divided into partial sounds, these circuits A55, A41, . . . are not necessary. Particularly, where the transient band of the formant control filter A20 is very wide and the entire frequency band of the musical tone waveform data TWj(t) all fits in this, these circuits A55, . . . are not necessary. Note that, when the musical tone pitch information (key number KN) or the band width BW from the adder A50 changes, the gain of the boundary portion of the partial musical tone waveform changes and gain matching in accordance with this is carried out.

Also, if the musical tone waveform data TWj(t) is a signal of a constant frequency irrespective of the musical tone pitch, for example, the formant waveform signal Ffj(t) or Fj(t), the adder A47 is omitted, and only the musical tone pitch information (key number KN) can be input to the contrast value—linear conversion circuit A48. In this case, the shift filter unit A0 of FIG. 2 is provided between the multiplier of the formant waveform control unit 60 and the formant form waveform generation unit 50 (or multiplier).

These as multipliers 66 and 652, respectively, are disclosed in the specifications and drawings of U.S. patent application Ser. Nos. 08/312,612, 08/394,279, and 08/493,324.

Figure 12:
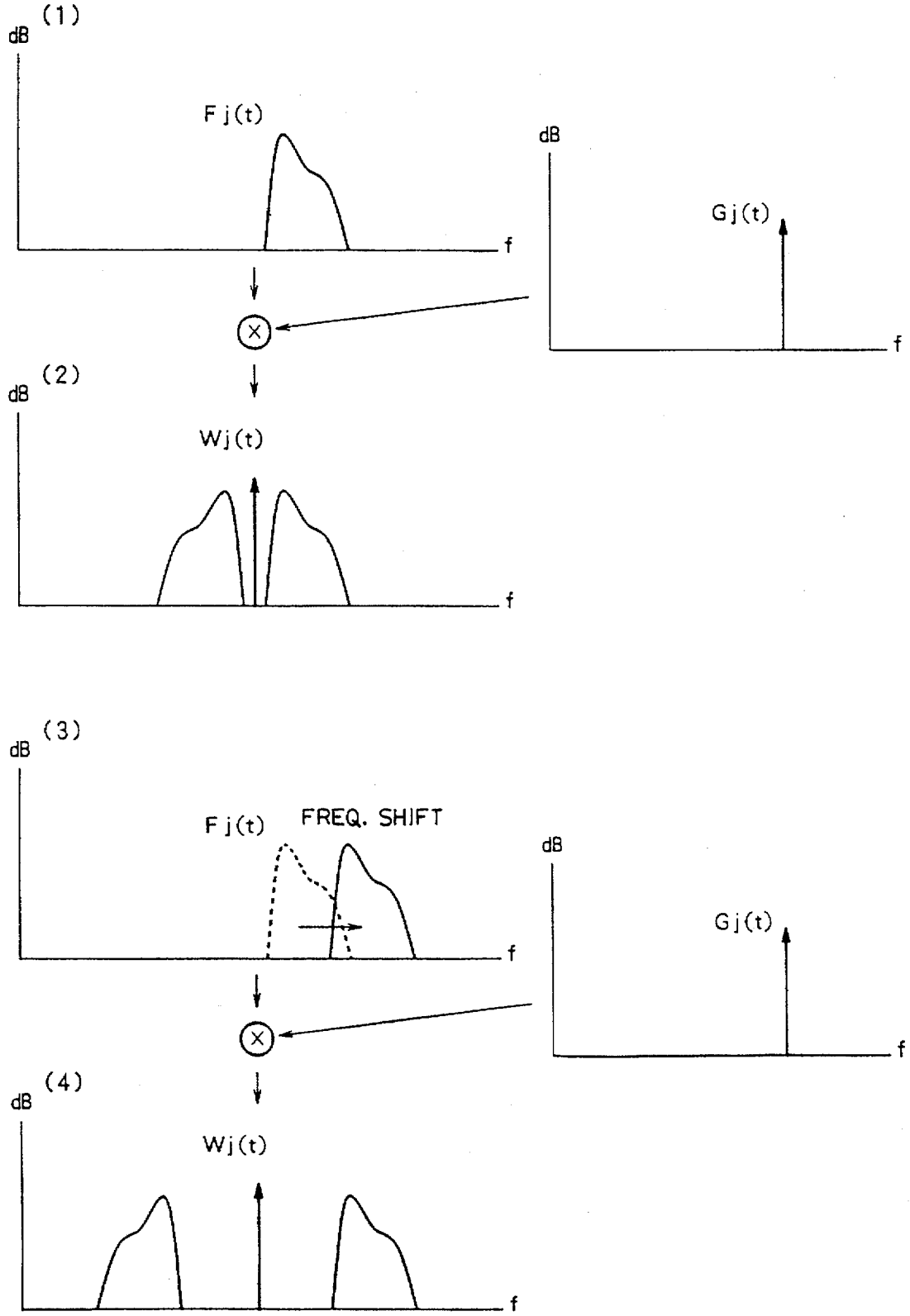
FIGS. 12(1)–12(4) are views showing a difference of the timbre (musical tone quality) of the musical tone by a frequency shift.

As described above, a musical tone in accordance with the musical tone pitch can be generated by the frequency shift. This musical tone in accordance with the musical tone pitch becomes not the horizontally symmetric formant form as shown in FIG. 12, but the horizontally asymmetric formant form as indicated by F8 of FIG. 15. Note that, the addition at the adder on the input side of the contrast value—linear conversion circuits A45, A48, A51 and A59 and the subtraction at the subtracter actually become the multiplication and division by the contrast value—linear conversion. 0f course, it is also possible if these contrast value—linear conversion circuits are omitted and the adder and subtracter are replaced by the multiplier etc. Moreover, it is also possible if a plurality of the shift filter units A0 are provided and the time division processing is omitted. In this case, the link data Linkj(t) is sent from the circuit A0 in which the frequency band of the partial musical tone waveform is low to the circuit A0 in which it is high.

3. Formant Control Filter A20

Figure 6:
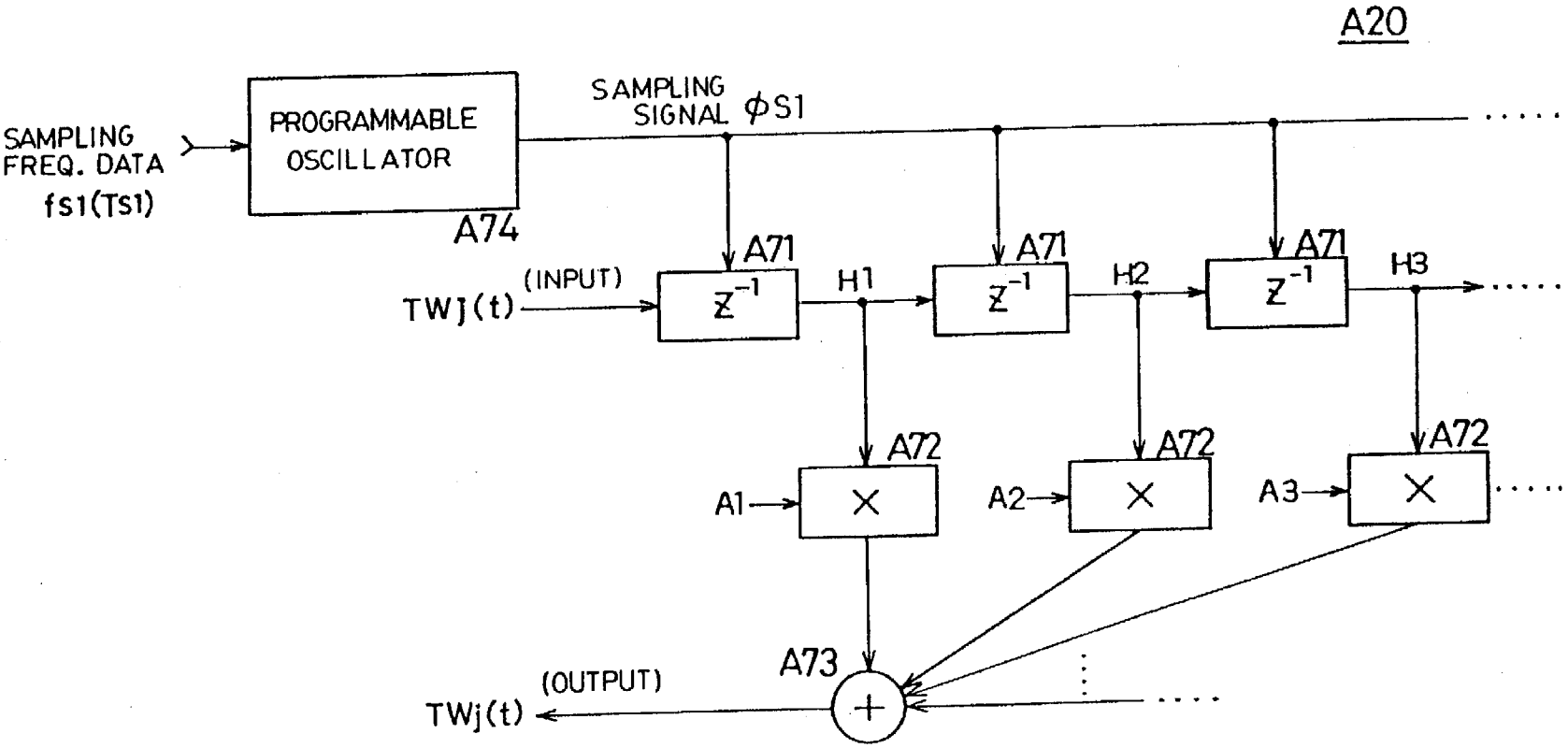
FIG. 6 is a circuit diagram showing the formant control filter A20 and filters A64 and A65.

FIG. 6 shows one example of the formant control filter A20. This filter is a FIR type digital filter performing a convolution operation. The delay units A71, . . . are constituted by for example CCDs, BBDs, etc., and the outputs of the taps become the outputs of the delay units A71, . . . . The outputs B1, H2, H3, . . . of these delay units A71, . . . are multiplied by the multiplication data A1, A2, A3, . . . at the multipliers A72, . . . , respectively, and added and synthesized at an adder A73 and output.

The delay time of the delay units A71, . . . is equal to the cycle Ts of the sampling frequency fs. This sampling signal θ s1 is supplied from the timing generation unit 30, the programmable counter or the programmable oscillator, etc. to the delay units A71, . . . (CCD). The sampling frequency data fs1 (Ts1) is input to the programmable oscillator A74, (or programmable counter) A74. Then, the sampling signal θ s1 of the frequency in accordance with this is input to the delay units A71, . . . , and the cut-off frequency is determined by this. Note that, this cut-off frequency is changed and determined also by the filter coefficient data A1, A2, A3, . . . .

Figure 7:
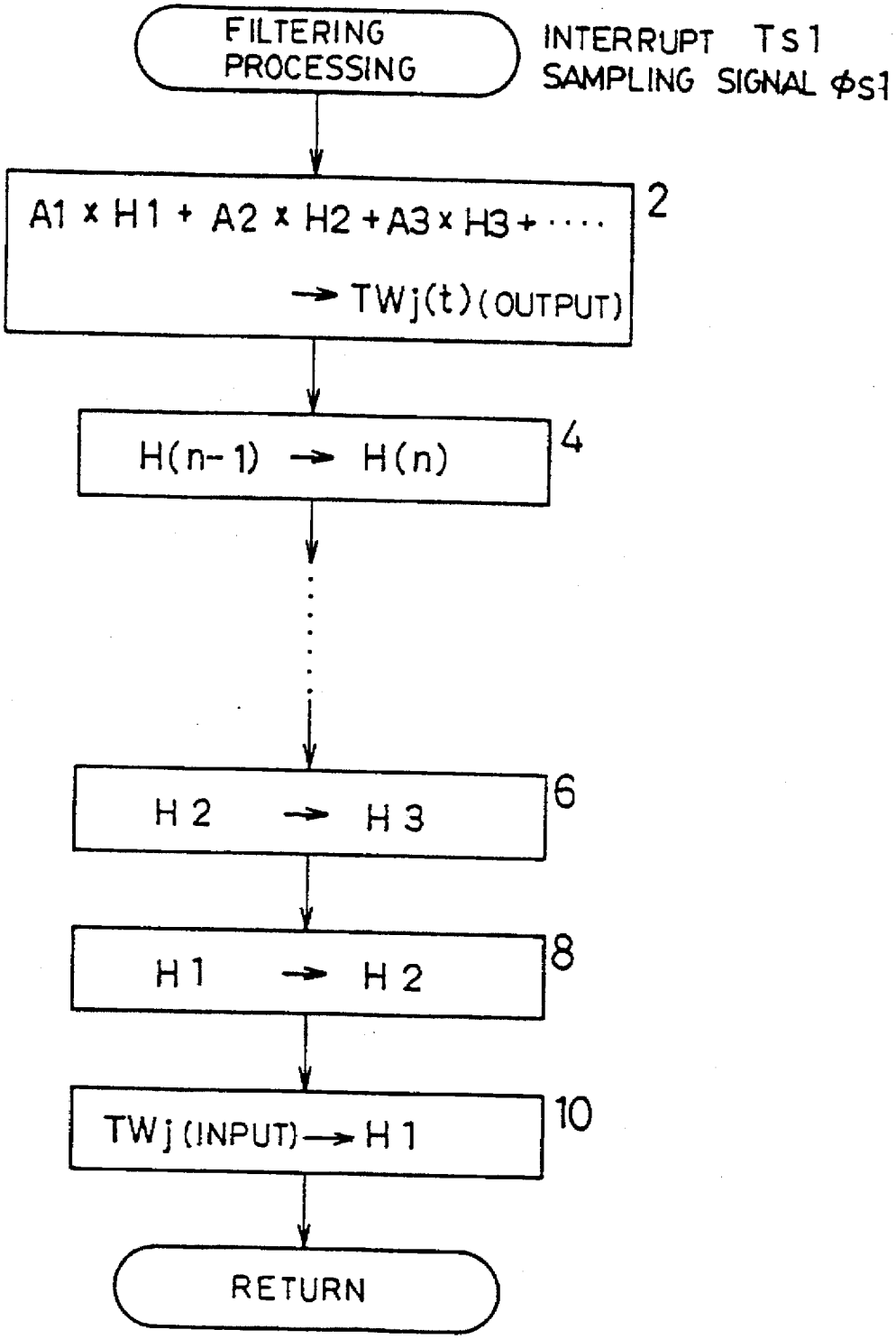
FIG. 7 is a view showing a flow chart of the filter processing of the formant control filter A20 and the filters A64 and A65.

FIG. 7 shows a flowchart of the operation when the formant control filter A20 is realized by a DSP (digital signal processor) or microcomputer. In this filtering processing, 1st to n-th order delay data H1 to Hn are multiplied by the filter coefficients A1 to Am, and the product sum of these multiplication data and the input musical tone waveform data TWj(t) is found and output (step 2). Then, the data B1 to Bn in the register of the RAM in the DSP are sequentially shifted from the n-th order delay data Hn to the delay data of a higher degree (steps 4 to 8). Finally, the input musical tone waveform data TWj(t) is shifted to the primary order delay data H1 (step 10). The above processing is repeated by an interrupt processing at a cycle Ts of the sampling frequency fs.

FIG. 8 shows the frequency characteristic of the formant control filter A20. In this characteristic, a band from the frequency "0" to near the cut-off frequency becomes the pass band, the band subsequent to the point near the cut-off frequency becomes the stop band, and the band near the cut-off frequency between this pass band and the stop band becomes the transient band. Almost all frequency bands of the musical tone waveform data TWj(t) fall into this transient band by the frequency shift by the first frequency shift unit A10 and are subjected to the above filter processing.

In this transient band, the attenuation characteristic gradually changes, therefore the amount of change of the frequency characteristic of the musical tone waveform data TWj(t) to be subjected to the filter control gradually changes as a whole from the fundamental wave toward the harmonics or from the harmonics toward the fundamental wave. For this reason, a change of only one part of the frequency characteristic of the musical tone waveform data TWj(t) no longer occurs, and the frequency characteristic of the same data TWj(t) gradually changes as a whole. Note that, the frequency characteristic of the formant control filter A20 has the pass band even near the frequency of an integral ratio (whole multiple) of the sampling frequency fs and similarly alternately has the stop band and the transient band. Accordingly, although the transient band was for the low-pass filter in the above example, if the area to be subjected to the filter processing is selected from other transient bands, also a transient band of a high-pass filter is realized.

FIG. 9 shows another frequency characteristic of the formant control filter A20. In this case, the formant control filter A20 is constituted by a plurality of filters, the musical tone waveform data TWj(t) is input to these plurality of filters in parallel, and the filter outputs are added and synthesized at the adder. As this foment control filter A20, also the filter operation means or the filter processing means shown in the specification and drawings of Japanese Unexamined Patent Publication No. 3-177898 (Japanese Patent Application No. 1-316514) can be used. It is deemed that all of the disclosed contents of the specification and drawings of this Japanese Unexamined Patent Publication No. 3-177898 are disclosed in the specification of the present application. Note that, the frequency characteristic of FIG. 9 may also be a horizontally symmetric frequency characteristic of this frequency characteristic and a frequency characteristic of a high-pass filter.

FIG. 10 shows a shift filter table A90. The frequency modulation information such as the shift control data SCj(t), frequency shift data FSj(t), sampling frequency data fs1 (Ts1), filter coefficient data A1, A2, A3, . . . , envelope speed data, envelope target data, generation frequency data GFj(t), vibrato in the musical effect information, etc. are stored in the shift filter table A85 for every musical factor, every elapsed time from the start of sound, every envelope level, or every envelope phase in multiple levels similar to the data SP, O, Min, Ta, Ea, formant waveform signal Ffj(t), formant density parameter ω fj(t), formant carrier parameter ω cj(t), n sets of parameter ω cjk(t), ajk(t), cj(t), the storage of the formant form table 212 or the formant center table 214 mentioned in the specifications and drawing of U.S. patent application Ser. Nos. 08/312,612, 08/394,279, and 08/493,324.

This musical factor is output from the performance information generation unit 10 as mentioned above. As the elapsed time from the start of sound, as mentioned above, the formant control parameter Valj(in a certain case, the accumulation formant density parameter Σ ω fj(t) or accumulation formant carrier parameter Σ ω cj(t)) or time count data is used. As the envelope level data, the formant control parameter alj(t) is used. The envelope phase is based on the count of the request data Req. This request data Req was mentioned in the specifications and drawings of U.S. patent application Ser. Nos. 08/312,612, 08/394,279. and 08/493,324.

The data such as these musical factors etc. are supplied to the table as the high-order reading address data. Also, information for every musical factor, etc. such as the data SCj(t), FSj(t), fs1(Ts1), GFj(t), A1, A2, . . . , envelope speed data, envelope level data, vibtaro,. etc. are selected and read out also by the selection data (high-order reading address data) input from the panel switches of the performance information generation unit 10 by the operator. Also, the frequency modulation information such as SCj(t), FSj(t), fs1 (Ts1), GFj(t), A1, A2, . . . , envelope speed data, envelope target data, vibrato, etc. are input from the performance information generation unit 10 by the operator.

It is also possible if the formant control parameter Valj, time count data, etc. which change according to the above envelope information or change according to the elapse of time are modified or synthesized with the musical factors by various calculations (operations, computations) (1) mentioned later.

Note that, it is also possible if the storage for every elapsed time from the start of sound or for every envelope level is omitted and the elapsed time from the start of the sound or the envelope level is modified and synthesized with respect to the data SCj(t), FSj(t), fs1 (Ts1), GFj(t), A1, A2, . . . , etc. This modification and synthesizing are according to the various calculations (operations, computations) (1) etc. mentioned later. A computation device for modifying and synthesizing the elapsed time from the sounding or envelope level is provided on an output end of the table.

Moreover, it is possible if the data SCj(t), FSj(t), rs1 (Ts1), GFj(t), A1, A2, . . . , etc. read out from the table as in the above way are written in the channel areas of the assignment memory 213 explained for FIG. 26 in the specifications and drawings of U.S. patent application Ser. Nos. 08/312,612, 08/394,279, and 08/493,324, read out in order by time division (time sharing manner), and supplied to the shift filter unit A0 of FIG. 2.

By the above control, in accordance with the musical factor, elapsed time from the start of sound or envelope level/phase, the amount of shift of the frequency band of the musical tone waveform data TWj(t) is changed. Also, by the control of the change of the sampling frequency data fs1 (Ts1) and the filter coefficient data A1, A2, A3, . . . , the frequency characteristic of the formant control filter A20 and cut-off frequency etc. are changed Also the transient band of the formant control filter A20 per se is shifted by this. As a result, the part (area) in the transient band in which the musical tone waveform data TWj(t) is subjected to the filter control is changed.

4. First Frequency Shift Unit A10

(second frequency shift unit A30)

FIG. 11 shows the first frequency shift unit A10 and the second frequency shift unit A30. The frequency shift data FSj(t) etc. or the generation frequency data GFj(t) etc. are accumulated for every channel at the accumulator A70 in a time sharing manner and supplied to a cosine table A60 and a sine table A61, respectively. Here, when assuming that this frequency shift data FSj(t) etc. or the generation frequency data GFj(t) etc. are ω sj, from the cosine table A60 and the sine table A61, shift data cosω sj(t) and sinω sj(t) are output. These shift data cosω sj(t) and sinω sj(t) are supplied to the multipliers A63 and A62, multiplied by the musical tone waveform data TWj(t), passed through the filters A65 and A64, and added and synthesized at the adder A66.

The musical tone waveform data TWj(t) is represented as follows by the principle of Fourier analysis.

$$TWj(t)=\Sigma An\times\cos\omega n(t)+\Sigma Bn\times\sin\omega n(t) \quad (A1)$$

Σ is a symbol indicating the accumulation from n=1 to n=m (m is any number). When the shift data cosω sj(t) and sinω sj(t) are multiplied with this, the result become as follows.

$$\begin{aligned} TWj(t)\times\cos\omega sj(t) &= \{\Sigma An\times\cos\omega n(t)+\Sigma Bn\times\sin\omega n(t)\}\times \\ &\quad \cos\omega sj(t) \\ &= 1/2\times\Sigma An\times\cos\{(\omega n+\omega sj)(t)\}+ \\ &\quad 1/2\times\Sigma Bn\times\sin\{(\omega n+\omega sj)(t)\}+ \\ &\quad 1/2\times\Sigma An\times\cos\{(\omega n-\omega sj)(t)\}+ \\ &\quad 1/2\times\Sigma Bn\times\sin\{(\omega n-\omega sj)(t)\} \end{aligned} \quad (A2)$$

$$\begin{aligned} TWj(t)\times\sin\omega sj(t) &= \{\Sigma An\times\cos\omega n(t)+\Sigma Bn\times\sin\omega n(t)\}\times \\ &\quad \sin\omega sj(t) \\ &= 1/2\times\Sigma An\times\sin\{(\omega n+\omega sj)(t)\}- \\ &\quad 1/2\times\Sigma Bn\times\cos\{(\omega n+\omega sj)(t)\}- \\ &\quad 1/2\times\Sigma An\times\sin\{(\omega n-\omega sj)(t)\}+ \\ &\quad 1/2\times\Sigma Bn\times\cos\{(\omega n-\omega sj)(t)\} \end{aligned} \quad (A3)$$

When these two pass through the low-pass filter, and the components of cos {(ω n+ω sj)(t)} and sin {(ω n+ω sj)(t)} are cut, they become as follows:

$$\begin{aligned} Icj(t) &= 1/2\times\Sigma An\times\cos\{(\omega n-\omega sj)(t)\}+ \\ &\quad 1/2\times\Sigma Bn\times\sin\{(\omega n-\omega sj)(t)\} \end{aligned} \quad (A4)$$

$$\begin{aligned} Isj(t) &= 1/2\times\Sigma Bn\times\cos\{(\omega n-\omega sj)(t)\}- \\ &\quad 1/2\times\Sigma An\times\sin\{(\omega n-\omega sj)(t)\} \end{aligned} \quad (A5)$$

When these two are added and synthesized, the following is obtained:

$$\begin{aligned} Iwj(t)- &= 1/2\times(\Sigma An+\Sigma Bn)\times\cos\{(\omega n-\omega sj)(t)\}+ \\ &\quad 1/2\times(\Sigma Bn-\Sigma An)\times\sin\{(\omega n-\omega sj)(t)\} \end{aligned} \quad (A6)$$

This means that all of the frequency band of the original musical tone waveform data TWj(t) except the amplitude, that is, all of the frequency components, are shifted exactly by −ω sj.

Also, when the above two pass through the high-pass filter, the components of cos {(ω n−ω sj)(t)} and sin {(ω n−ω sj)(t)} are cut, the results added and synthesized, and the following is obtained:

$$\begin{aligned} Iwj(t)+ &= 1/2\times(\Sigma An-\Sigma Bn)\times\cos\{(\omega n+\omega sj)(t)\}+ \\ &\quad 1/2\times(\Sigma An+\Sigma Bn)\times\sin\{(\omega n+\omega sj)(t)\} \end{aligned} \quad (A7)$$

Also this means that the frequency band of the original musical tone waveform data TWj(t) except the amplitude, that is, all of the frequency components, are all shifted exactly by ω sj. In the frequency shift of these ±ω sj, the density of the frequency components of the frequency band of the musical tone waveform data TWj(t) does not change. However, the harmonics ratio of the frequency components of the frequency band changes, and the timbre (musical tone quality) finely changes Where the frequency shift of the musical tone waveform data TWj(t) is set to −ω sj, the filters A64 and A65 act as low-pass filters, while when the frequency shift is set to +ω sj, the filters A64 and A65 act as high-pass filters. The cut-off frequency of the low-pass filter and high-pass filter is ω sj. Note that, usually the shift angle frequency ω sj is a value larger than the frequency band width ω n (BW) of the musical tone waveform data TWj(t), for example, almost the same value, two times the value, three times the value, . . . , but it is also possible if this value is smaller than the frequency band width ω n. The filters A64 and A65 are realized by for example the circuit of FIG. 6 or the processing of FIG. 7.

In accordance with this, the value of the band width BW is magnified by 1, 2, 3, . . . , at the multiplier (data shifter)

A68, added with the shift amount ω sj at the adder A69, and input to the programmable oscillator (or programmable counter) A67. Then, the sampling signal θ s2 of the frequency in accordance with this is input to the filters A64 and A65, and the cut-off frequency is determined by this. Note that, this cut-off frequency is changed and determined also by the filter coefficient data (A0), A1, A2, A3, . . . , B1, B2, B3, . . . of the filters A4 and A65.

Moreover, it is also possible to omit the multiplier (data shifter) A63. Further, the filter coefficient data of the filters A64 and A65 can be stored in the shift filter table A85 in multiple levels similar to the filter coefficient data A1, A2, A3, . . . , similarly input, modified, synthesized, changed, etc.

Note that, it is also possible to omit the sine table A60, multiplier A62, and the filter A64 of FIG. 11 or to omit the cosine table A61, multiplier A63, and the filter A65. Also, due to this, a frequency shift can be carried out.

FIG. 12 shows the state of the frequency shift by this first frequency shift unit A10 (second frequency shift unit A30) when the musical tone waveform data TWj(t) is the formant waveform signal Ffj(t) or Fj(t). The formant waveform signals Ffj(t) and Fj(t) and the formant carrier signal Gj(t) are synthesized at the multiplier 66 in the format waveform control unit 60 as described previously and output as the formant synthesized signal Wj(t) (musical tone signal). Here, if the formant form of the formant waveform signals Ffj(t) and Fj(t) is the form shown in FIG. 12(1), the formant form of the formant synthesized signal Wj(t) becomes that of FIG. 12(2).

Here, if the formant waveform signals Ffj(t) and Fj(t) are shifted in frequency as shown in FIG. 12(3), the formant form of the formant synthesized signal Wj(t) becomes as shown in FIG. 12(4). This frequency-shift formant form of FIG. 12(4) and the formant form of FIG. 12(2) have different frequency components. In addition the harmonics ratio of the frequency components of this frequency band are different, and the timbre (musical tone quality) are different. Accordingly, the timbre (musical tone quality) can change by such a frequency shift. The amount of this frequency shift changes in accordance with the musical factor, the elapsed time from sounding, the envelope level/phase, etc. as mentioned above. Therefore, also the timbre (musical tone quality) change by this frequency shift changes in accordance with the musical factor, elapsed time from sounding, envelope level/phase, etc.

5. Shift Filter Unit A0 (second embodiment)

Figure 13:
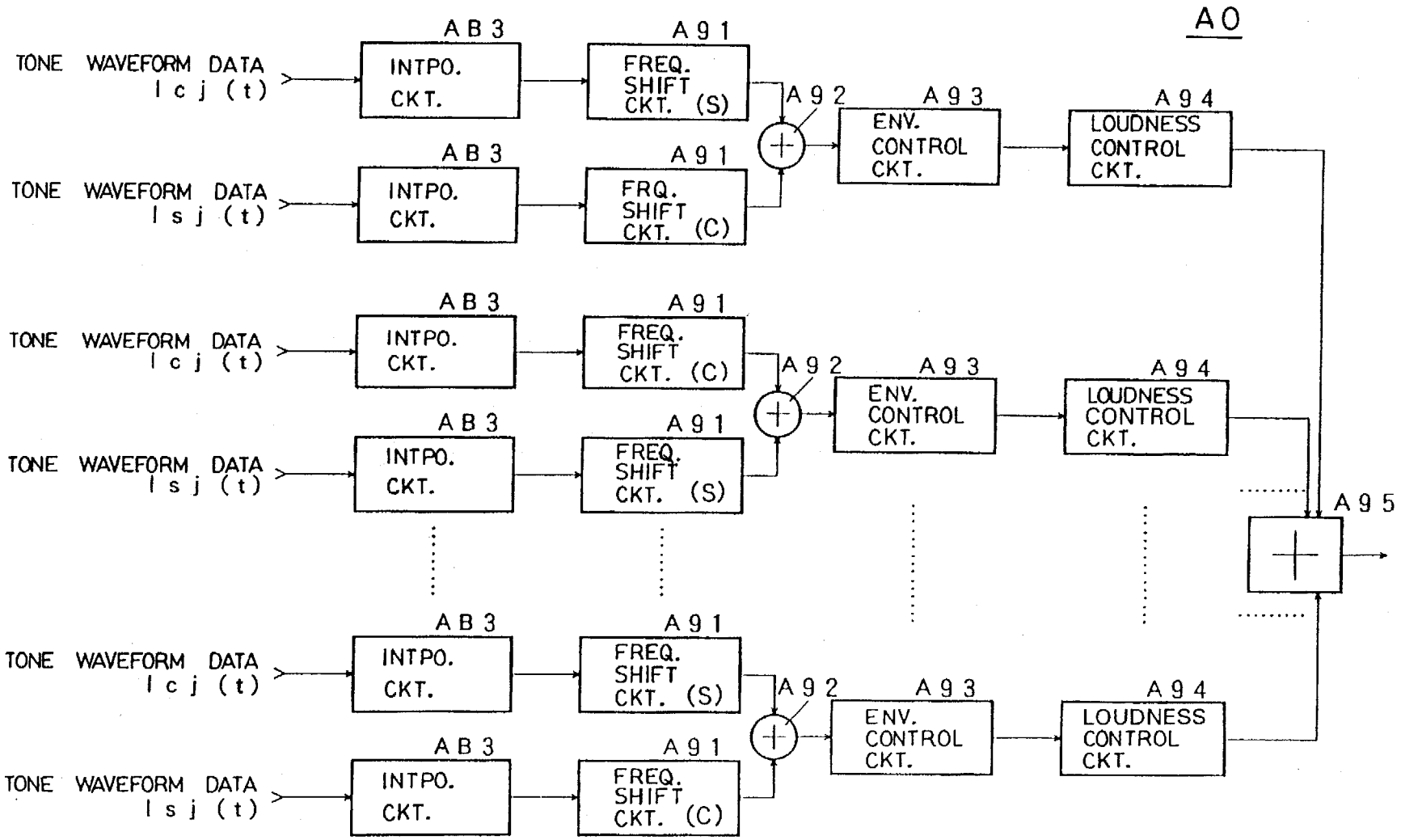
FIG. 13 is a circuit diagram showing the shift filter unit A0 (second embodiment)

FIG. 13 shows the second embodiment of the shift filter unit A0. This shift filter unit A0 is provided between the multiplier 66 in the formant waveform control unit 60 and the formant form waveform generation unit 50 (or multiplier 652). Then, the musical tone waveform data TWj(t) to be input is the signal of a constant frequency irrespective of the musical tone pitch, for example, the formant waveform signals Ffj(t) and Fj(t). However, this musical tone waveform data TWj(t) to be input may be a signal in accordance with the musical tone pitch too, for example, the formant synthesized signal Wj(t), formant carrier signal Gfj(t), Gf(t), and cosω cj(t). In this case, the shift filter unit A0 is provided between the formant waveform control unit 60 and the accumulation unit 70. For matters other than explained in the following description, reference is made to the explanation of the shift filter unit A0 given above.

The frequency-shifted musical tone waveform data Icj(t) and Isj(t) from the filters A64 and A65 of the frequency shift unit A10 (A30) are interpolated at the sampling points by the interpolation circuits AB3 and AB3, shifted in frequency by the frequency shift circuits A91 and A91, added and synthesized at an adder A92, subjected to envelope control at an envelope control circuit A93, subjected to loudness control at a loudness control circuit A94, added and synthesized at an adder A95, and output to the multiplier 66 or the accumulation unit 70 in the formant waveform control unit 60. Note that, the envelope control circuit A92 or the loudness control circuit A93 can be omitted.

It is also possible if the musical tone waveform data Icj(t) and Isj(t) are stored in the musical tone waveform memory A05 as will be mentioned later. As the interpolation circuit AB3, it is also possible to use the apparatus shown in the specifications and drawings of Japanese Unexamined Patent Publication No. 51-8924 (Japanese Patent Application No. 49-80307), U.S. Pat. No. 4,111,090, U.S. Pat. No. 4,114,496, Japanese Unexamined Patent Publication No. 63-98699 (Japanese Patent Application No. 61-246310), U.S. Pat. No. 5,245,126, U.S. Pat. No. 5,117,725 and Japanese Unexamined Patent Publication No. 3-204696 (Japanese Patent Application No. 1-343476). It is deemed that all of the disclosed contents of these specifications and drawings are disclosed in the specification of the present application as they are.

6. Frequency Shift Unit A10 (A30)

Figure 14:
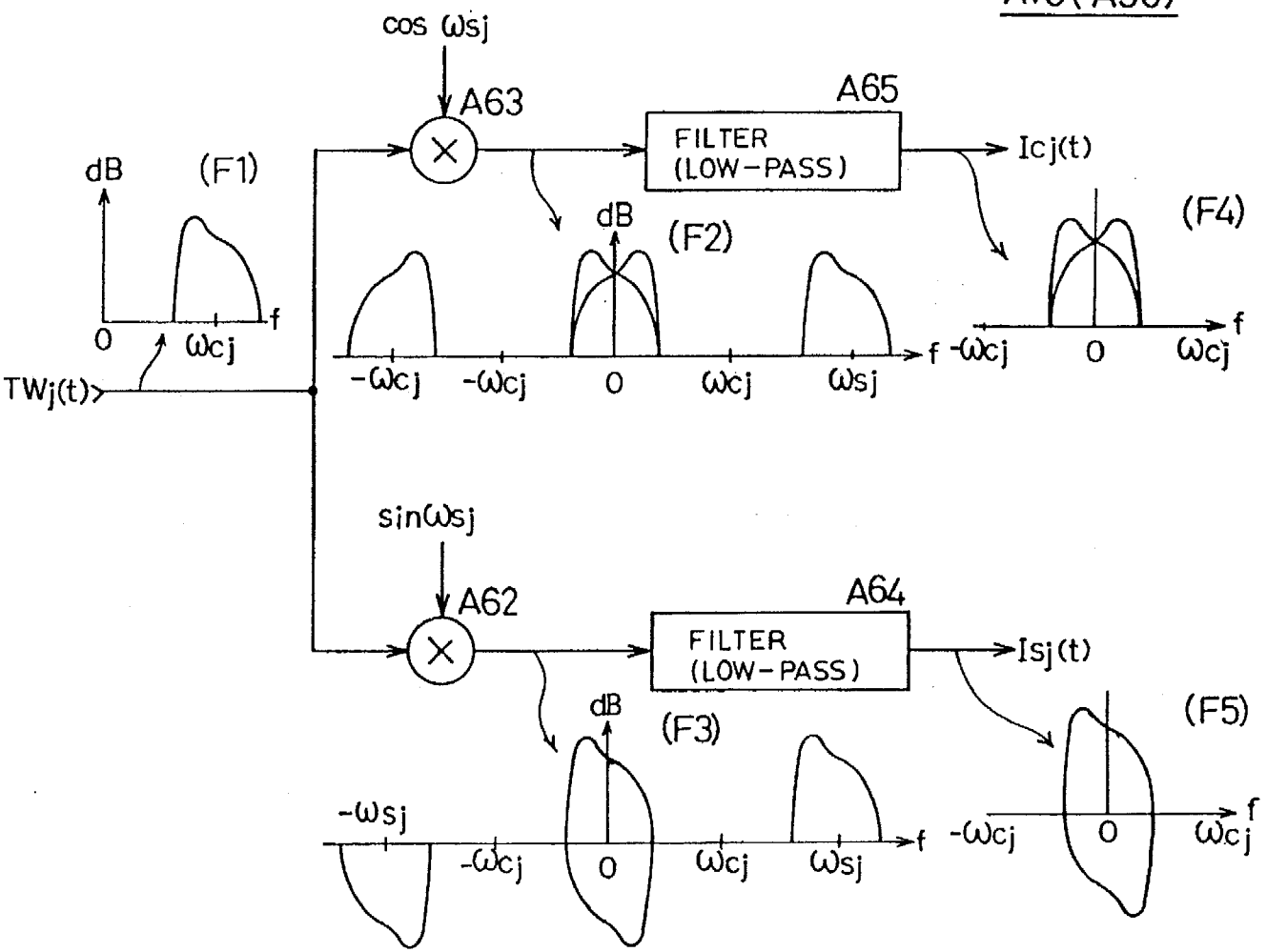
FIG. 14 is a view showing the operation of the frequency shift unit A10 (A30)

FIG. 14 shows a circuit generating the musical tone waveform data Icj(t) and Isj(t). The circuit of FIG. 14 is the same as the first (second) frequency shift unit A10 (A30) of FIG. 11 mentioned above except for the adder A66. Accordingly, also in the first (second) frequency shift unit A10 (A30) of FIG. 11, an operation the same as the operation shown in FIG. 14 is performed. In the circuit of FIG. 14, the formant forms of the musical tone signals of different portions (units) are shown. For matters other than provided in the following description, reference is made to the explanation of the circuit of FIG. 11 mentioned above.

If the formant form of the musical tone waveform data TWj(t) is F1 of FIG. 14, the formant form of the musical tone waveform data obtained by multiplication by cosω sj(t) at the multiplier A63 becomes F2 of the same figure. This formant form F2 has also an imaginary minus frequency component. Also, the formant form of the musical tone waveform data obtained by multiplication by sinω sj(t) at the multiplier A62 becomes F3. This formant form F3 has also the imaginary minus frequency component and minus component.

In this case, the value of the center angle frequency ω c of the musical tone waveform data TWj(t) and the value of the angle frequency shift amount ω s of the cosω sj(t) and the sin sj(t) are the same. Due to this, the center frequency of the frequency band of the frequency-shifted musical tone waveform data TWj(t) becomes zero. Of course, it is possible if the value of ω c and the value of ω s are different. Then, the formant forms of the musical tone waveform data Icj(t) and Isj(t) passed through the filters (low-pass) A65 and A64 become F4 and F5. Due to this, one formant having a frequency near zero is selected and extracted from among a plurality of formants having the same form generated by the frequency shift.

In this way, by the frequency shift, the musical tone waveform data TWj(t) of the formant F1 is converted to the musical tone waveform data Icj(t) and Isj(t) of the formants F4 and F5 of the center frequency of "0". Accordingly, the storage sampling frequency of the musical tone waveform data Icj(t) and Isj(t) can be lower than the storage sampling frequency of the musical tone waveform data TWj(t), and therefore the musical tone waveform data TWj(t) can be stored after data compression.

Each of these musical tone waveform data Icj(t) and Isj(t) or the musical tone waveform data obtained by addition and synthesizing or multiplication and synthesizing of these two musical tone waveform data Icj(t) and Isj(t) is stored in the musical tone waveform memory A05 of FIG. 2 as the musical tone waveform data TWj(t). Parts of these musical tone waveform data Icj(t), Isj(t) and TWj(t) consist of a plurality of partial musical tone waveforms in which the frequency bands substantially do not overlap or partially overlap, pass through the second frequency shift unit A30 or the adder A92 mentioned later, and then are synthesized to one musical tone and output. It is also possible if the musical tone waveform memory A05 is made detachable with respect to the musical tone generation apparatus and is a CD-ROM/RAM, ROM/RAM card, etc.

These large number of musical tone waveform data Icj(t) and Isj(t) to be stored include various types of data, stored in multiple levels for every musical factor such as timbre, musical tone pitch range, touch, etc., for every elapsed time from sounding, for every envelope level/phase, and for every selection data by the operator, and the data in accordance with these musical factors, etc. are read out. Note that, it is also possible if this musical tone waveform data is subjected to the frequency shift at the first frequency shift unit A10 (second frequency shift unit A30) or filter control at the formant control filter A20. Due to this, the center angle frequency of the musical tone waveform data Icj(t) and Isj(t) is "0", and therefore the processing of the frequency shift becomes easy. Moreover, it is also possible if the frequency shift unit A10 (A30) of FIG. 14 is provided on the input side of the interpolation circuit AB3.

7. Frequency Shift Circuit A91

Figure 15:
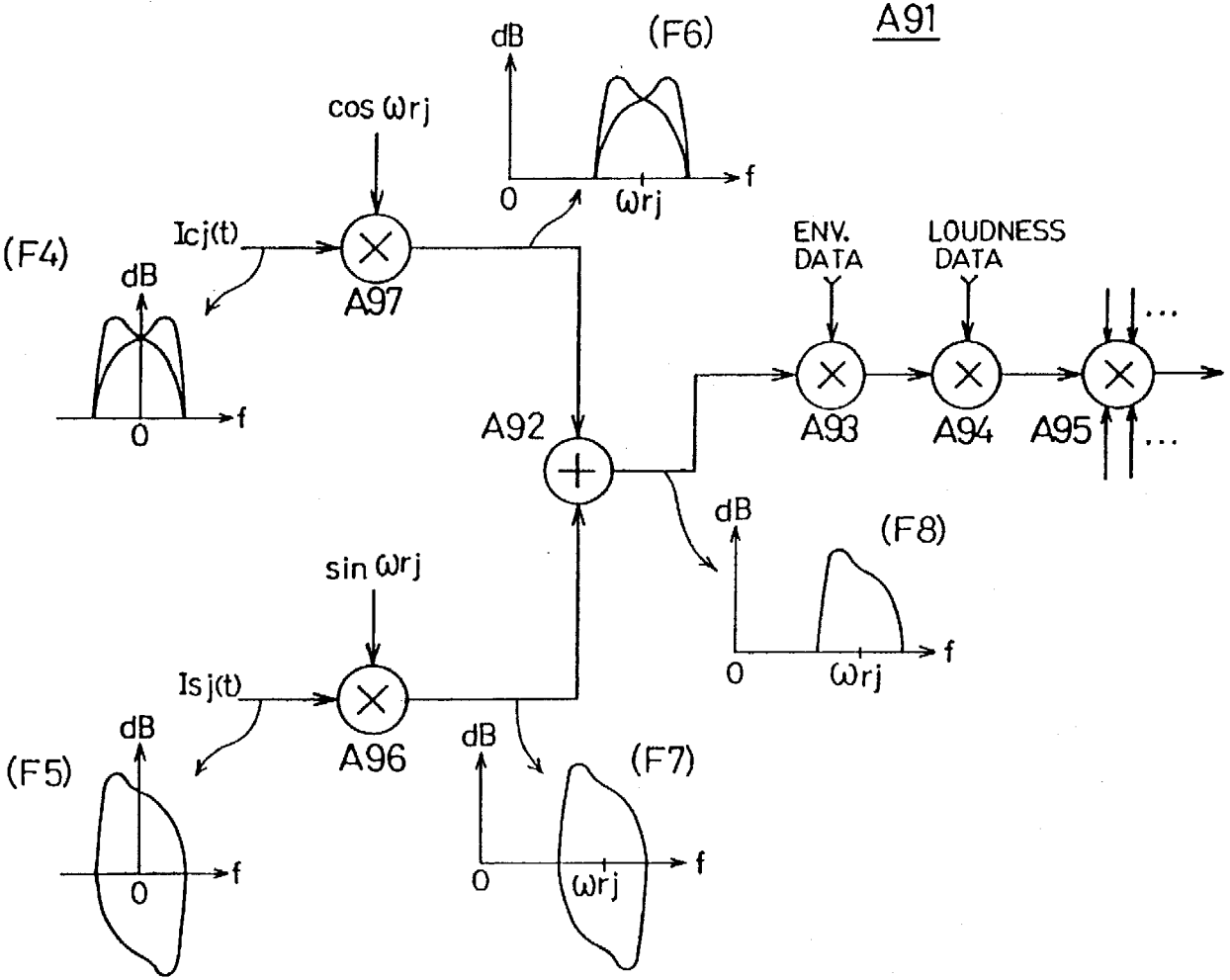
FIG. 15 is a circuit diagram showing a frequency shift circuit A91 etc.

FIG. 15 shows the frequency shift circuit A91 and the adder A92 etc. In the multipliers A97 and A96, the read out musical tone waveform data Icj(t) and Isj(t) are multiplied by cosω rj(t) and sinω rj(t) to carry out the frequency shift of the angle frequency ω rj. The formant form of the musical tone waveform data Icj(t) and Isj(t) passed through the multipliers A97 and A96 become the F6 and F7 frequency shifted in accordance with the angle frequency ω rj. These formant forms F6 and F7 virtually exist also on the minus frequency side, but have been omitted.

These frequency-shifted musical tone waveform data Icj (t) and Isj(t) are added and synthesized at the adder A92, reproduced, and output. Due to this, the plus frequency components and the minus frequency components of the musical tone waveform data Icj(t) and Isj(t) are cancelled by each other, the formant form of the synthesized musical tone waveform data becomes F8, and the formant F1 of the original musical tone waveform data TWj(t) is shifted in frequency intact by exactly the angle frequency ω rj.

This added and synthesized musical tone waveform data is subjected to envelope control at the envelope control circuit A93, subjected to loudness control at the loudness control circuit A94, and added and synthesized with the other musical tone waveform data at the adder A95. These envelope control circuit A93 and loudness control circuit A94 comprise multipliers. As the envelope data to be sent to this envelope control circuit A93 and the loudness data to be sent to the loudness control circuit A94, any of the data Valj (aj(t), cj(t), dj(t)) mentioned in the specifications and drawings of U.S. patent application Ser. Nos. 08/312,612, 08/394,279, and 08/493,324 are used.

Also, in the frequency shift circuit A91 of FIG. 15, although not illustrated, the same circuits as the accumulator A70, the cosine table A60, and the sine table A61 of FIG. 11 are provide, and the cosω rj(t) and sinω rj(t) are input from these cosine table A60 and the sine table A61 to the multipliers A97 and A96. To this accumulator A70, the frequency shift data ω rj is input. This frequency shift data ω rj is generated in exactly the same way as that for the frequency shift data ω sj. Accordingly, this frequency shift amount ω rj changes in accordance with the musical factor, elapsed time from sounding, envelope level/phase, settings and instructions by the operator, etc. Moreover, both of the envelope data to be sent to the envelope control circuit A93 and the loudness data to be sent to the loudness control circuit A94 change in accordance with the musical factor, elapsed time from sounding, envelope level/phase, settings and instructions by the operator, etc.

Further, the frequency shift amount ω rj can be set to a value in accordance with the musical tone pitch (key number KN) of the musical tone to be generated. Due to this, the musical tone in accordance with the musical tone pitch can have not the horizontally symmetric formant form of FIG. 12, but the horizontally asymmetric formant form of F8 of FIG. 15. In this case, by this frequency shift, the density of the frequency components of the frequency band of the musical tone waveform data TWj(t) does not change, and also the width of formant does not change. However, the harmonics ratio of the frequency components of the frequency band changes, and the timbre (musical tone quality) finely changes. Also, the value of the frequency shift amount ω rj at the time of reproduction (playback) is the same as the value of the frequency shift data ω sj at the time of the storage. It is also possible if the plus and minus signs are reversed.

8. Shift filter unit A0 (third embodiment)

Figure 16:
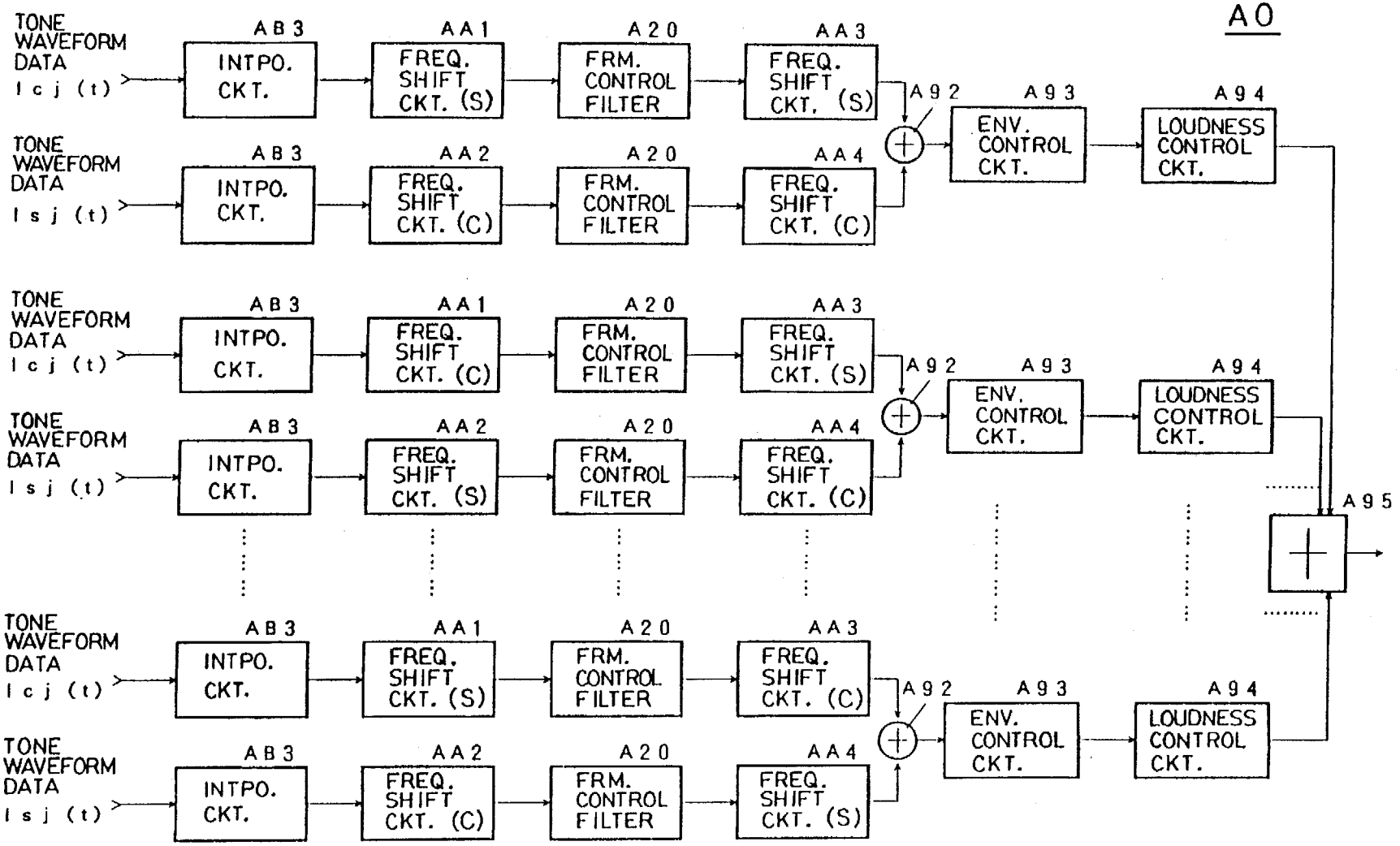
FIG. 16 is a circuit diagram showing the shift filter unit A0 (third embodiment)

FIG. 16 shows the third embodiment of the shift filter unit A0. This shift filter unit A0 can be completely replaced by the shift filter unit A0 of the second embodiment of FIG. 13 mentioned above. Accordingly, explanations of the same portions (units) as those of the second embodiment are omitted, but it is assumed that these explanations of the same portions are all disclosed here. For matters other than in the following description, reference is made to the explanation of the shift filter unit A0 given above.

The musical tone waveform data Icj(t) and Isj(t) frequency-shifted or read out from the filters A64 and A65 of the frequency shift unit A10 (A30) are interpolated at the sampling points by the interpolation circuits AB3 and AB3, shifted in frequency by the frequency shift circuits AA1 and AA2, subjected to filter control at the formant control filters A20 and A20, shifted in frequency by the frequency shift circuits AA3 and AA4, added and synthesized at the adder A92, subjected to envelope control by the envelope control circuit A93, subjected to loudness control by the loudness control circuit A94, added and synthesized at the adder A95, and output to the multiplier 66 in the formant waveform control unit 60 or the accumulation unit 70. Note that, the envelope control circuit A92 or the loudness control circuit A93 can be omitted. The circuit generating the musical tone waveform data Icj(t) and Isj(t) is the same as the circuit shown in FIG. 15 or the first (second) frequency shift unit A10 (A30) of FIG. 11 excluding the adder A66.

9. Frequency Shift Circuits AA1 to AA4

Figure 17:
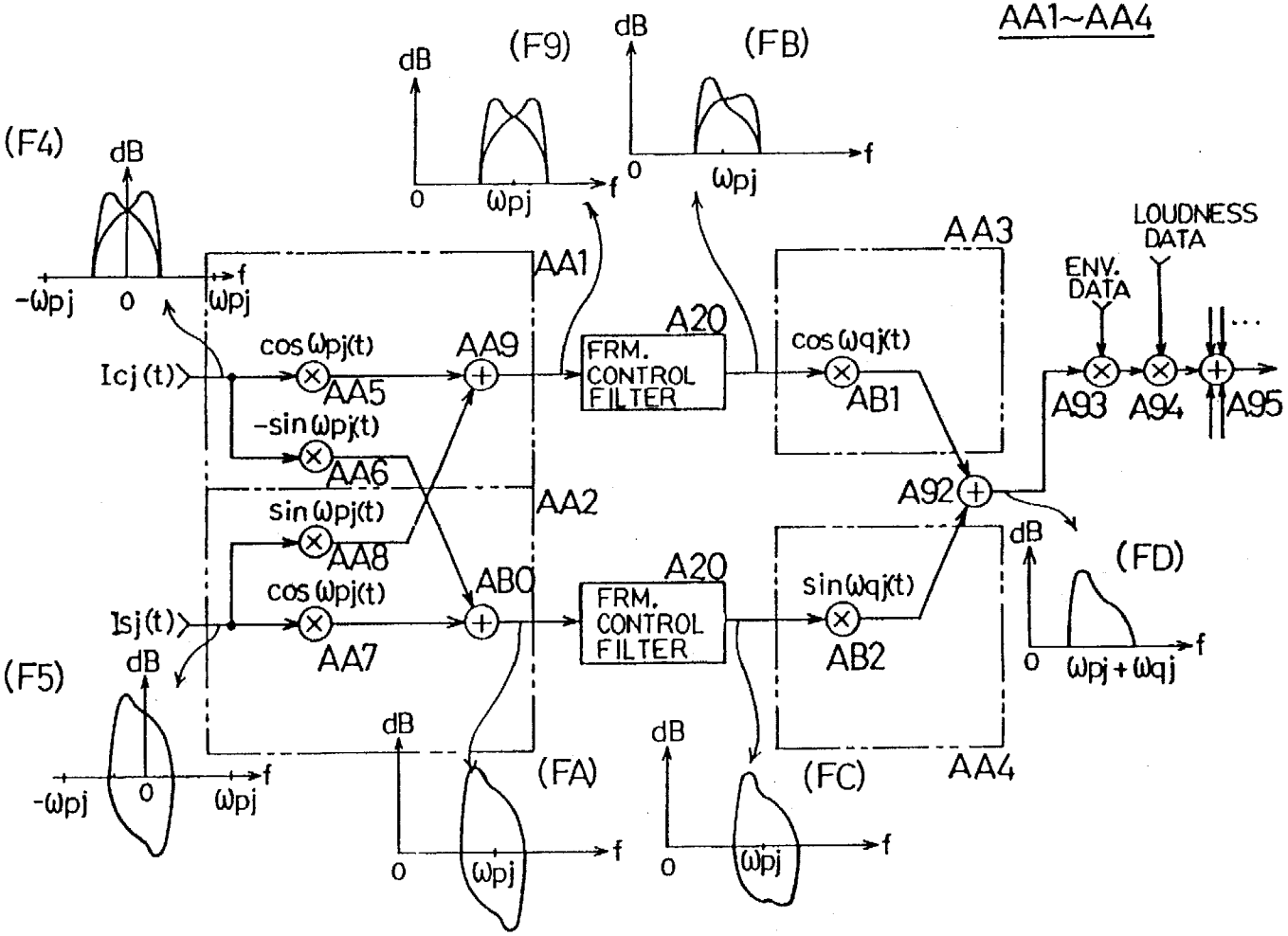
FIG. 17 is a circuit diagram showing frequency shift circuits AA1 to AA4 etc.

FIG. 17 shows the frequency shift circuits AA1, AA2, formant control filters A20, A20, frequency shift circuits AA3 and AA4, and an adder A92. The explanation of the formant control filter A20 mentioned above is referred to for matters other than the following description. In the multipliers AA5 and AA6, cosω pj(t) and −sinω pj(t) are multiplied with the musical tone waveform data Icj(t) to carry out the frequency shift of the angle frequency ω pj. In the multipliers AA7 and AA8, cosω pj(t) and sinω pj(t) are multiplied with the musical tone waveform data Isj(t) to carry out the frequency shift of the angle frequency ω pj.

The data from the multipliers AA5 and AA8 are added and synthesized at an adder AA9, and the data from the multipliers AA6 and AA7 are added and synthesized at an adder AB0. The formant forms of the musical tone waveform data Icj(t) and Isj(t) passed through these adders AA9 and AB0 become F9 and FA frequency-shifted in accordance with the angle frequency ω pj. The frequency components of formants on the minus frequency side are cancelled by each other between plus and minus. These frequency-shifted musical tone waveform data Icj(t) and Isj(t) are subjected to the above filter control at the formant control filters A20 and A20. Due to this, as shown in the formant forms FB and FC, the frequency components of formant are changed. This amount of change gradually changes as a whole from the fundamental wave toward the harmonics or from the harmonics toward the fundamental wave.

The musical tone waveform data from this formant control filter A20 is multiplied by cosω qj(t) at the multiplier AB1 of the frequency shift circuit AA3 to carry out the frequency shift of the angle frequency ω qj. The musical tone waveform data from another formant control filter A20 is multiplied by sinω qj(t) at the multiplier AB2 of the frequency shift circuit AA4 to carry out the frequency shift of the angle frequency ω qj. These musical tone waveform data from the multipliers AB1 and AB2 are added and synthesized at the adder A92, reproduced, and output. Due to this, the plus frequency components and minus frequency components of the musical tone waveform data Icj(t) and Isj(t) are cancelled by each other and the formant form of the synthesized musical tone waveform data becomes FD, consequently the formant F1 of the original musical tone waveform data TWj(t) is subjected to the filter control, and the frequency shift is carried out exactly by the angle frequency ω pj+ω qj.

In the frequency shaft circuits AA1 to AA4 of FIG. 17, the same circuits as the accumulator A70, cosine table A60, and sine table A61 of FIG. 11 are provided though they are not illustrated. From these cosine table A60 and sine table A61, the cosω pj(t), ±sinω pj(t), cosω qj(t) and sinω qj(t) are input to the multipliers AA5 to AA8, AB1, and AB2. To this accumulator A70, the frequency shift data ω pj and ω qj are input. These frequency shift data ω pj and ω qj are generated in exactly the same way as that for the frequency shift data ω sj.

Accordingly, these frequency shift amounts ω pj and ω qj change in accordance with the musical factor, elapsed time from sounding, envelope level/phase, settings and instructions of the operator, etc . . . . Also, the frequency shift amounts ω pj and ω qj can be set to those in accordance with the musical tone pitch (key number KN) to be generated. Due to this, the musical tone in accordance with the musical tone pitch can have not the horizontally symmetric formant form of FIG. 12, but the horizontally symmetric formant form of FD of FIG. 17. In this case, by this frequency shift, the density of the frequency components of the frequency band of the musical tone waveform data TWj(t) does not change, and the width of the formant does not change either. However, the harmonics ratio of the frequency components of the frequency band changes and the timbre (musical tone quality) finely changes. Also, the value of the frequency shift amount ω pj+ω qj at the time of the reproduction (playback) can be the same as the value of the frequency shift data ω sj at the time of the storage, and it is also possible if the plus and minus signs are reversed.

10. Formant Control Filter A20 (second embodiment)

Figure 18:
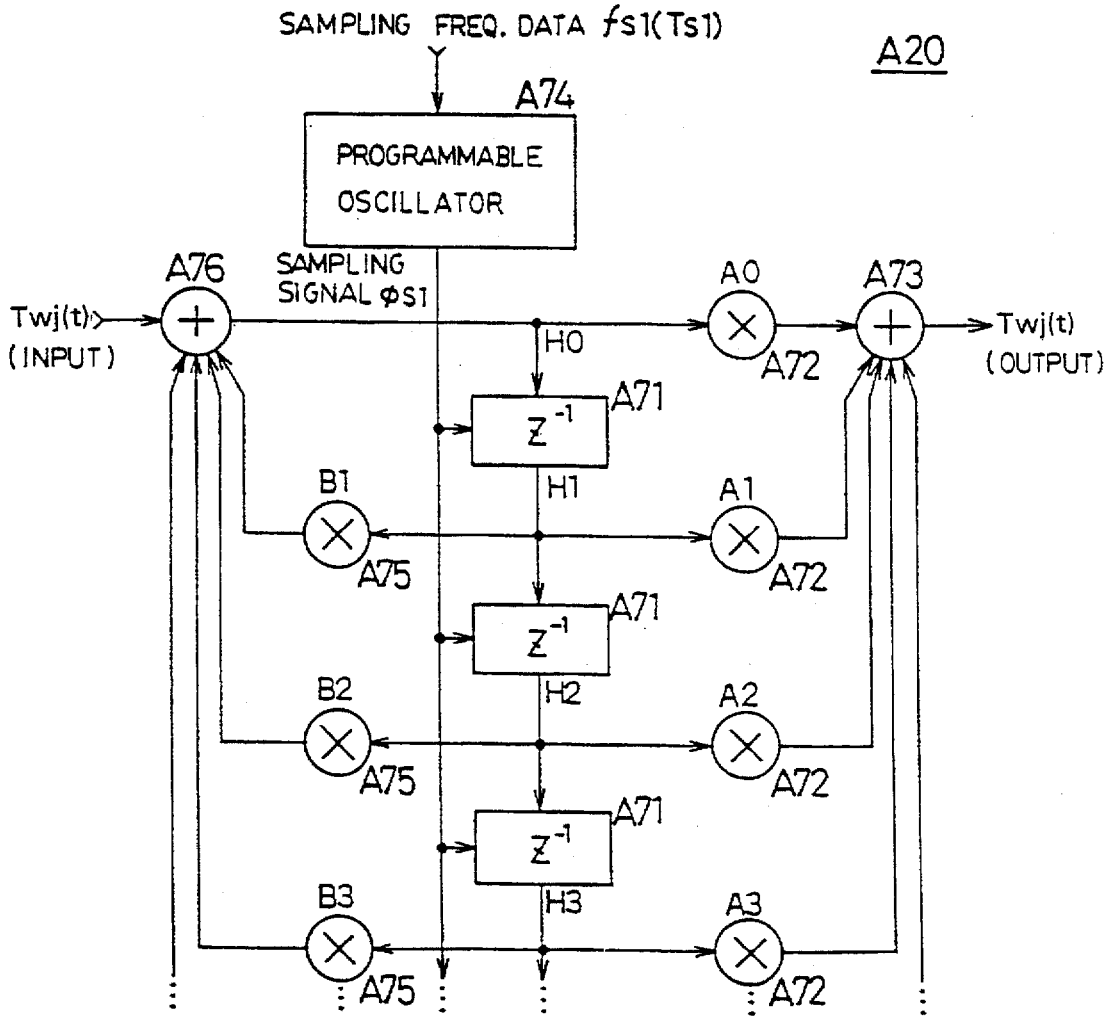
FIG. 18 is a circuit diagram showing the formant control filter A20 and the filters A64 and A65 (second embodiment)

FIG. 18 shows the second embodiment of the formant control filter A20 and the filters A64 and A65. For matters other than in the following description, reference is made to the explanation of the formant control filter A20 and the filter A64 or A65 given above. This filter is an IIR type digital filter performing a convolution operation. The delay units A71, . . . are constituted by for example CCDs, BBDs, etc., and the outputs of the taps become the outputs of the delay units A71, . . . . The input musical tone waveform data TWj(t) passed through the adder A76, and the outputs H1, B2, H3, . . . of these delay units A71, . . . are multiplied by multiplication data A0, A1, A2, A3, . . . at the multipliers A72, . . . , added and synthesized at an adder A73 and output. Also, the outputs H1, H2, H3, . . . of the delay units A71, . . . are-multiplied by multiplication data B1, B2, B3, . . . at the multipliers A75, . . . , and added and synthesized to the input musical tone waveform data TWj(t) at the adder A76.

The delay time of the delay units A71, . . . is equal to the cycle Ts of the sampling frequency fs. This sampling signal θ s1 is supplied from the timing generation unit 30, programmable counter, or programmable oscillator A74, etc. to the delay units A71, . . . (CCD). The sampling frequency data fs (Ts) is input to the programmable oscillator (or programmable counter) A74. Then, the sampling signal θ s1 having the frequency in accordance with this is input to the delay units A71, . . . , and the cut-off frequency is determined by this. Note that, this cut-off frequency is changed and determined also by the filter coefficient data A0, A1, A2, A3, . . . , B1, B2, B3, . . . .

Figure 19:
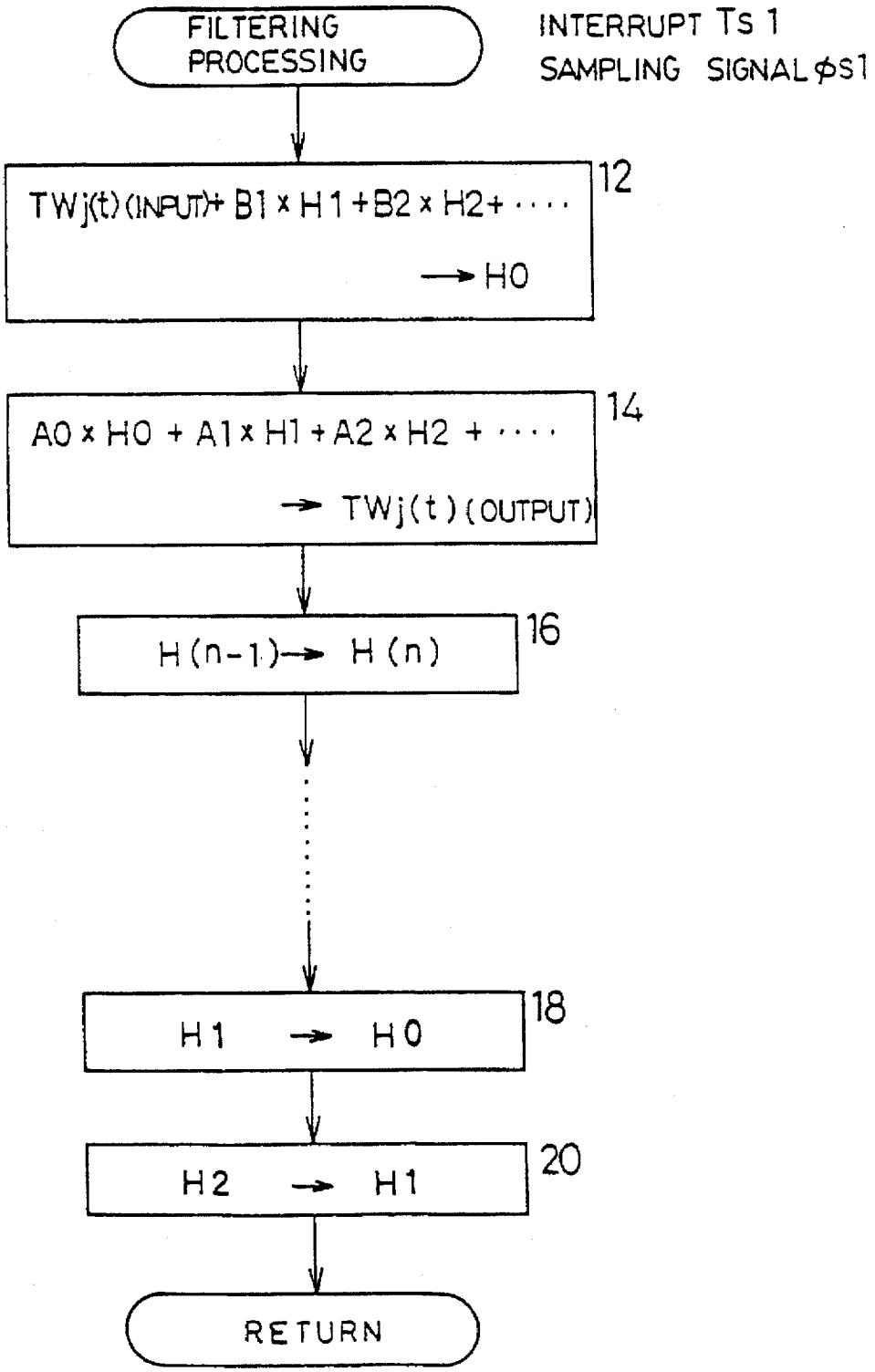
FIG. 19 is a circuit diagram showing a flowchart of the filter processing of the formant control filter A20 and the filters A64 and A65 (second embodiment) and FIG. 20. is a circuit diagram showing the formant control filter A20 and the filters A64 and A65 (third embodiment).

FIG. 19 shows a flowchart of the operation when the formant control filter A20 is realized by a DSP (digital signal processor) or a microcomputer. In this filtering processing, the filter coefficients B1 to Bn are multiplied with the primary (1-th) to n-th order delay data H1 to Hn, the product sum including these multiplication data and the input musical tone waveform data TWj(t) is found, and this is stored in the register of the RAM in the DSP as th u=rent data H0 (step 12). Next, the filter coefficients A0 to Am are multiplied with the current data B0, primary to n-th order delay data H1 to Hn, the product sum of these multiplication data is found, and the result output (step 14). Then, the data H0 to Hn in the register of the RAM in the DSP are sequentially shifted from the n-th order delay data Hn to the delay data of a degree higher than them by one (steps 16 to 20). The above processing is repeated by interrupt processing at a cycle Ts1 of the sampling frequency fs1.

The sampling frequency data fs1 (Ts1), filter coefficient data A0, A1, A2, . . . , B1, B2, . . . are stored in the shift filter table A85 in multiple levels for every musical factor, elapsed time from the start of sound, every envelope level or envelope phase in exactly the same way as that for the sampling frequency data fs1 (Ts1) and the filter coefficient data A1, A2, . . . , and selected and read out by the selection data input from the panel switches of the performance information generation unit 10 by the operator, and further input from the performance information generation unit 10 by the operator, and also subjected to modification and synthesizing by various calculations (operations, computations) (1) etc.

11. Formant Control Filter A20 (third embodiment)

Figure 20:
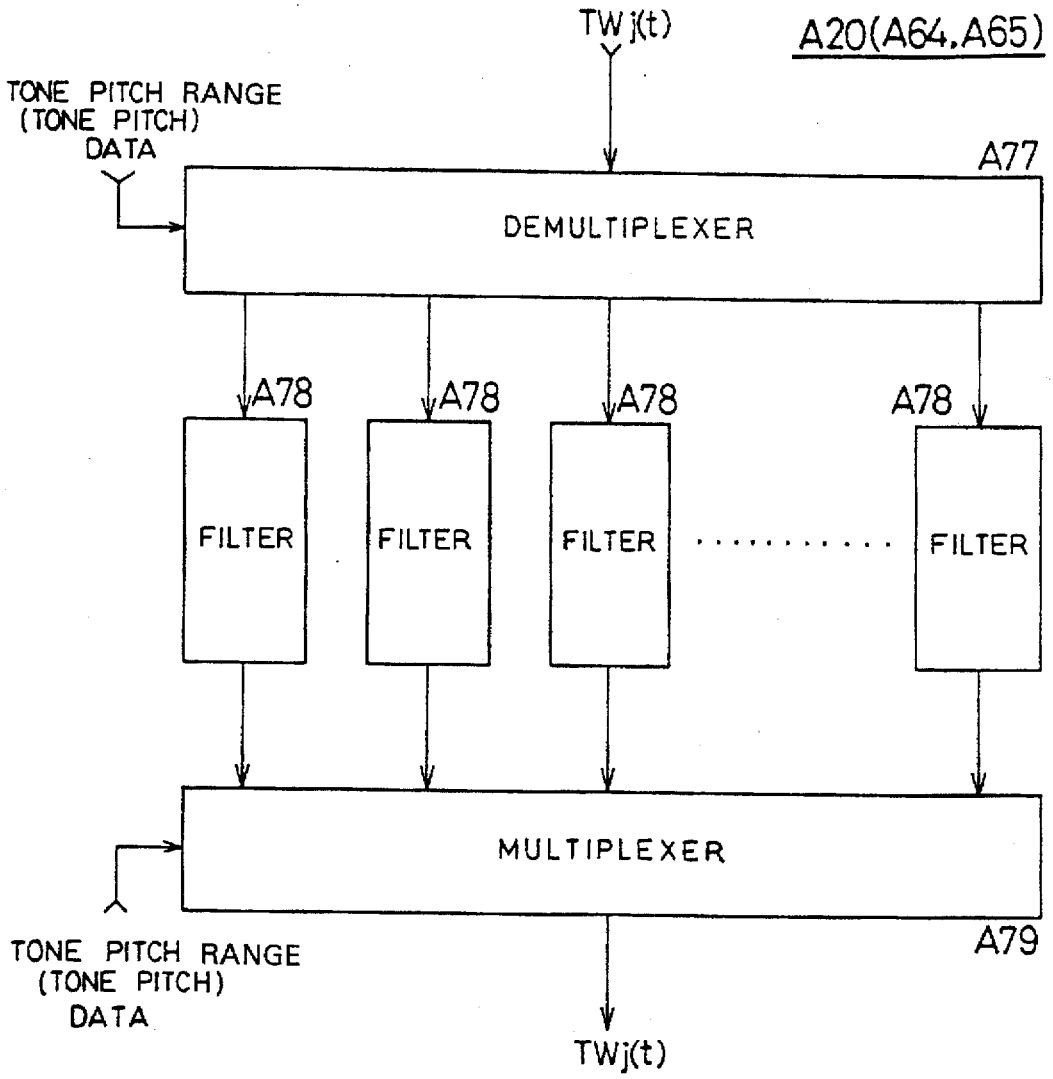

FIG. 20 shows the third embodiment of the formant control filter A20 and the filters A64 and A65. For matters other than in the following description, reference is made to the explanation of the formant control filter A20 and the filter A64 or A65 given above. The musical tone waveform data TWj(t) is input to any of the filters A78, . . . via a demultiplexer A77, the filter control is carried out for this, and the resultant data is output via a multiplexer A79. The filters A78, . . . are shown in FIG. 6, FIG. 7, FIG. 18, or FIG. 19. The positions of frequency of the transient bands of the filters A78, . . . or cut-off frequencies are different corresponding to the musical tone pitch range (musical tone pitch).

The high-order musical tone pitch range data of he musical tone pitch information (key number data KN) from the adder A01 or the high-order musical tone pitch range data of the frequency number data FN from the frequency number table A03 is supplied as the selection (switching) data to the demultiplexer A77 and multiplexer A79. In this case, the first frequency shift unit A10 and the subtracters A49 and A52 are omitted, the output from the filter gain table A55 is computed and modified in accordance with the musical tone pitch range data (musical tone pitch information), and modification in accordance with the positions on the frequency of the transient bands of the filters A78, . . . is carried out. Also, the frequency shift at the second frequency shift unit A30 becomes exactly the frequency shift in accordance with the low-order tone name (sound name) data of the musical tone pitch information, or the second frequency shift unit A30 is omitted.

The above embodiments of the invention are by no means limitative. Various changes and modifications are possible without departing from the scope and spirit of the invention. For example, it is also possible if the musical tone waveform data Icj(t) and Isj(t) from the filters A64 and A65 of the frequency shift unit A10 (A30) of FIG. 2, FIG. 11, and FIG. 14 to FIG. 17, the musical tone waveform data TWj(t) from the first frequency shift unit A10 or the second frequency shift unit A30, or the musical tone musical tone waveform data generated from the portions (units) of the multipliers A62, A63, A96, A97, AA5, AA6, AA7, AA8, AB1, AB2, adders A92, A95, AA9, AB0, and the formant control filter A20 are once stored in the musical tone waveform memory A05 for every musical factor, every elapsed time from start of sound, every envelope level, every envelope phase, or every setting and instruction of the operator. Then, these generated and stored data are input to the circuit subsequent to the generation portions (units).

In this case, the musical tone waveform data Icj(t), Isj(t) and TWj(t) to be read out are switched or changed for every musical factor, every elapsed time from the start of sound, every envelope level, every envelope phase, or every setting and instruction of the operator. Then, in the musical factor, it is also possible if the formant control parameter Valj, time count data, etc. which change according to the above envelope information or change according to the elapse of time are synthesized by various calculations (operations, computations) (1), etc. mentioned later. These read out musical tone waveform data Icj(t), Isj(t) and TWj(t) are input to the circuit subsequent to the generation portions (units).

Note that, it is also possible if the storage for every elapsed time from the start of sound or for every envelope level is omitted, and the elapsed time from the start of sound or the envelope level is modified and synthesized with respect to the musical tone waveform data Icj(t), Isj(t) and TWj(t). This modification and synthesizing are according to the various calculations (operations, computations) (1), etc. mentioned later, and a calculation (computation) device which modifies and synthesizes the elapsed time from the start of sound or envelope level is provided on the output end of the musical tone waveform memory A05.

"Various calculations (operations, computations) (1) mentioned later" mentioned above or in following portions (units) mean the addition or subtraction of the data at the adder, the multiplication or division of the data at the multiplier, the combined operations of them at the adder and multiplier, other additional operations of the data, other multiplication operations of the data, bit shift operations of the other data by a certain data at the data shifter, a synthesizing operations in which a certain data becomes a high-order data and the data of the other data becomes low-order data, the calculations (computations) of the data based on the equations at the calculation (computation) circuit, etc., the read out of the calculated (computed) data resulting from the storage of the calculated (computed) data of the data in the memory and that data being made the read out address data, and so on.

It is also possible if one of the musical tone waveform data Icj(t) and Isj(t) is a component waveform data obtained by extracting only the cosine component from a certain musical tone waveform data TWj(t), and the other is a component waveform data obtained by extracting only the sine component from a certain musical tone waveform data TWj(t). Such an extraction is carried out by an even number transversal filter 13 and an odd number transversal filter 14 disclosed in the specification and drawings of U.S. Pat. No. 4,313,361. The frequency of the sampling signal to be supplied to these transversal filters 13 and 14 is switched In a wide range, whereby the cosine component and sine component are divided and extracted in the entire frequency band.

We claim:

1. A musical tone control apparatus comprising:

musical tone waveform generation means for generating a musical tone waveform;

filter means for filter processing the musical tone waveform generated by said musical tone waveform generation means, said filter means filter processing all of the frequency bands of the musical tone waveform only in a transient band between a pass band and a stop band thereof;

control means for restricting the frequency band of the musical tone waveform so that the frequency band of the musical tone waveform generated by said musical tone waveform generation means is within the transient band of said filter means; and musical tone output means for outputting the musical tone waveform subjected to filter processing by said filter means as a musical tone.

2. The musical tone control apparatus as set forth in claim 1, further comprising:

musical tone control data generation means for generating musical tone control data; and transient band selection means for selecting an area in which filter processing is carried out in the transient band of said filter means based on the musical tone control data generated by said musical tone control data generation means.

3. The musical tone control apparatus as set forth in claim 1, wherein an area in which filter processing is carried out in the transient band of said filter means is selected by a frequency shift of the frequency band of the musical tone waveform or by a frequency shift of the transient band of said filter means.

4. The musical tone control apparatus as set forth in claim 1, wherein said musical tone waveform generation means comprises partial musical tone waveform generation means for generating a plurality of partial musical tone waveforms having different frequency bands.

5. The musical tone control apparatus as set forth in claim 4, wherein a frequency characteristic of a portion of the transient band of said filter means in which filter processing is carried out is linear, the plurality of partial musical tone waveforms being subjected to filter processing only in the linear portion such that even if an actual frequency characteristic of the transient band of said filter means is nonlinear, the frequency characteristic of the transient band becomes linear.

6. The musical tone control apparatus as set forth in claim 2, wherein the musical tone control data generated by said musical tone control data generation means is generated in accordance with musical factors, an elapsed time from starting of sound, an envelope level, an envelope phase, or an operator setting and instruction.

7. The musical tone control apparatus as set forth in claim 1, wherein said musical tone output means comprises synthesizing and outputting means for synthesizing a plurality of partial musical tone waveforms into a resultant waveform and outputting the resultant waveform as one musical tone.

8. A musical tone control apparatus comprising:

musical tone waveform generation means for generating a musical tone waveform;

first frequency shift means for shifting a frequency band of the musical tone waveform generated by said musical tone waveform generation means in frequency without a change of density of frequency components of the frequency band;

filter means for filter processing the musical tone waveform subjected to the frequency shift by said first frequency shift means;

second frequency shift means for shifting the musical tone waveform subjected to filter processing by said filter means to a frequency in accordance with a musical tone pitch;

musical tone output means for outputting the musical tone waveform subjected to the frequency shift by said second frequency shift means as the musical tone pitch;

first frequency shift data generation means for generating first frequency shift data which determines an amount of the frequency shift by said first frequency shift means so that the frequency band of the musical tone waveform output from said musical tone waveform generation means is shifted by said first frequency shift means within a transient band of said filter means and for providing the first frequency shift data to said first frequency shift means; and second frequency shift data generation means for modifying the first frequency shift data in accordance with the musical tone pitch and for providing the modified first frequency shift data to said second frequency shift means.

9. The musical tone control apparatus as set forth in claim 8, wherein said filter means performs filter processing for all frequency bands of the musical tone waveform in the transient band between a pass band and a stop band of the musical tone waveform or performs filter processing for the frequency band of the musical tone waveform over a range from the pass band to the stop band.

10. The musical tone control apparatus as set forth in claim 8, wherein said first frequency shift means multiplies and synthesizes a sine wave signal and a cosine wave signal having a same frequency as the musical tone waveform generated by said musical tone waveform generation means and adds and synthesizes the synthesized signal after passing through a loss-pass filter or a high-pass filter.

11. The musical tone control apparatus as set forth in claim 8, wherein the first frequency shift data generated by said first frequency shift data generation means comprises data for selecting a band of a frequency characteristic of said filter means to be used.

12. The musical tone control apparatus as set forth in claim 8, wherein said musical tone waveform generation means comprises partial musical tone waveform generation means for generating a plurality of partial musical tone waveforms having different frequency bands.

13. The musical tone control apparatus as set forth in claim 8, wherein the first frequency shift data generated by said first frequency shift data generation means is generated in accordance with musical factors, elapsed time from a start of sound, envelope level, envelope phase, or operator settings and instructions.

14. The musical tone control apparatus as set forth in claim 8, wherein said musical tone output means comprises synthesizing and outputting means for synthesizing a plurality of partial musical tone waveforms into a resultant waveform and outputting the resultant waveform as one musical tone.

15. A musical tone control apparatus comprising:

musical tone waveform generation means for generating a musical tone waveform;

frequency shift means for shifting a frequency band of the musical tone waveform generated by said musical tone waveform generation means in frequency without a change of density of frequency components of the frequency band;

frequency shift data generation means for generating frequency shift data which determines an amount of the frequency shift by said frequency shift means and for providing the frequency shift data to said frequency shift means; and musical tone output means for outputting the musical tone waveform subjected to the frequency shift by said frequency shift means as a musical tone.

16. The musical tone control apparatus as set forth in claim 15, wherein said musical tone output means converts the musical tone waveform to the musical tone in accordance with a musical tone pitch and outputs the musical tone.

17. The musical tone control apparatus as set forth in claim 15, wherein said frequency shift means multiplies and synthesizes a sine wave signal and a cosine wave signal having a same frequency as the musical tone waveform generated by said musical tone waveform generation means and adds and synthesizes the synthesized signal after passing through a loss-pass filter or a high-pass filter.

18. The musical tone control apparatus as set forth in claim 15, wherein the frequency shift data generated by said frequency shift data generation means comprises data for selecting a band of the frequency characteristic of said frequency shift means to be used.

19. The musical tone control apparatus as set forth in claim 15, wherein said musical tone waveform generation means comprises partial musical tone waveform generation means for generating a plurality of partial musical tone waveforms having different frequency bands.

20. The musical tone control apparatus as set forth in claim 15, wherein the frequency shift data generated by said frequency shift data generation means is generated in accordance with musical factors, elapsed time from a start of sound, envelope level, envelope phase, or operator settings and instructions.

21. The musical tone control apparatus as set forth in claim 15, wherein said frequency shift means shifts the musical tone waveform to a frequency in accordance with a musical tone pitch.

22. The musical tone control apparatus as set forth in claim 15, wherein said musical tone output means comprises synthesizing and outputting means for synthesizing a plurality of partial musical tone waveforms into a resultant waveform and outputting the resultant waveform as one musical tone.

23. A method of musical tone waveform storage comprising the steps of:

a) generating a musical tone waveform;

b) shifting a frequency band of the musical tone waveform generated in said step a) in frequency without a change of density of frequency components of the frequency band;

c) selecting and extracting at least one formant from among a plurality of formants having a same form generated in said step b) by using filter processing;

d) storing the musical tone waveform subject to selection and extraction in said step c); and e) generating and providing first frequency shift data which determines an amount of the frequency shift in said step b).

24. The method of musical tone waveform storage as set forth in claim 23, further, comprising:

f) reading the musical tone waveform stored in said step d);

g) shifting the frequency band of the musical tone waveform read out in said step f) in frequency without a change of density of the frequency components of the frequency band;

h) outputting the musical tone waveform subjected to the frequency shift in said step g) as a musical tone; and i) generating and providing second frequency shift data which determines an amount of the frequency shift of said step g).

25. The method of musical tone waveform storage as set forth in claim 23, wherein a center frequency of the frequency band of the musical tone waveform subjected to the frequency shift in said step b) is zero.

26. The method of musical tone waveform storage as set forth in claim 24, wherein the frequency shift in said step g) is in accordance with musical tone pitch.

27. The method of musical tone waveform storage as set forth in claim 24, wherein the frequency shift in said step b) and the frequency shift in said step g) have shift directions inverse to each other and a same shift amount.

28. The method of musical tone waveform storage as set forth in claim 24, wherein the frequency shift in said step b) or the frequency shift in said step g) comprises multiplying and synthesizing a sine wave signal and a cosine wave signal having a same frequency as the musical tone waveform subjected to the frequency shift.

29. The method of musical tone waveform storage as set forth in claim 23, wherein said step a) comprises generating a plurality of partial musical tone waveforms having different frequency bands.

30. The method of musical tone waveform storage as set forth in claim 23, wherein said step d) comprises storing the musical tone waveform while dividing the musical tone waveform into a sine wave component and a cosine wave component.

31. The method of musical tone waveform storage as set forth in claim 23, wherein said step d) comprises storing the musical tone waveforms in accordance with musical factors, elapsed time from a start of sound, envelope level, envelope phase, or operator settings and instructions.

32. The method of musical tone waveform storage as set forth in claim 23, wherein said step b) comprises shifting a musical tone waveform in accordance with musical factors, elapsed time from a start of sound, envelope level, envelope phase, or operator settings and instructions.

33. The method of musical tone waveform storage as set forth in claim 24, wherein said step h) comprises synthesizing a plurality of partial musical tones and outputting the synthesized partial musical tones as one musical tone.

34. The method of musical tone waveform storage as set forth in claim 24, wherein said step g) comprises shifting the musical tone waveform in accordance with musical factors, elapsed time from a start of sound, envelope level, envelope phase, or operator settings and instructions.

35. A musical tone control apparatus comprising:

partial musical tone waveform generation means for generating a plurality of partial musical tone waveforms having different frequency bands;

filter means for filter processing the plurality of partial musical tone waveforms generated by said partial musical tone waveform generation means;

synthesizing and outputting means for synthesizing the plurality of partial musical tone waveforms subjected to filter processing by said filter means and for outputting the plurality of partial musical tone waveforms synthesized as one musical tone; and gain matching means for matching gains of boundary portions of the frequency bands of the plurality of partial musical tone waveforms synthesized by said synthesizing and outputting means and bringing a gain of the frequency band of a certain one of the plurality of partial musical tone waveforms into coincidence with the gain of the frequency band of the other of the plurality of partial musical tone waveforms.

36. The musical tone control apparatus as set forth in claim 35, wherein said gain matching means comprises:

gain characteristic generation means for generating a gain characteristic in accordance with a filter characteristic of said filter means;

gain obtaining means for obtaining the gains of the boundary portions of the frequency bands of the plurality of partial musical tone waveforms from the gain characteristic; and boundary gain matching means for matching the gains of said boundary portions based on the gains obtained by said gain obtaining means and bringing the gain of the frequency band of the certain one of the plurality of partial musical tone waveforms into coincidence with the gain of the frequency band of the other of the plurality of partial musical tone waveforms.

37. The musical tone control apparatus as set forth in claim 36, wherein said gain obtaining means obtains the gain of the frequency band of the certain one of the plurality of partial musical tone waveforms in said boundary portion and the gain of the frequency band of the other of the plurality of partial musical tone waveforms, said boundary gain matching means determining a difference between the obtained gains and performing a modification operation in accordance with the difference.

38. The musical tone control apparatus as set forth in claim 35, wherein the partial musical tone waveforms change in frequency in accordance with a change of generation speed and the gain of said boundary portion also changes in accordance with the change of generation speed.

39. The musical tone control apparatus as set forth in claim 35, wherein said partial musical tone waveform generation means comprises:

partial musical tone waveform storage means for storing the plurality of partial musical tone waveforms; and reading means for reading the plurality of partial musical tone waveforms from said partial musical tone waveform storage means.

40. The musical tone control apparatus as set forth in claim 35, wherein said filter means performs filter processing for all frequency bands of the plurality of partial musical tone waveforms in transient bands between pass bands and stop bands of the plurality of partial musical tone waveforms.

41. The musical tone control apparatus as set forth in claim 35, wherein a filter characteristic of said filter means changes in accordance with musical factors, elapsed time from a start of sound, envelope level, envelope phase, or operator settings and instructions.

42. The musical tone control apparatus as set forth in claim 35, wherein said filter means performs filter processing of the frequency bands of the plurality of partial musical tone waveforms over a range from pass bands to stop bands of the plurality of partial musical tone waveforms.

* * * * *